US005415559A

United States Patent [19]

Ichimura

[11] Patent Number: 5,415,559

[45] Date of Patent: May 16, 1995

[54] ELECTRICAL CONNECTOR HAVING A PLURALITY OF CONTACT PIN SPRINGS

[75] Inventor: Yoshiaki Ichimura, Tokyo, Japan

[73] Assignee: Japan Aviation Electronics Industry, Ltd., Japan

[21] Appl. No.: 63,017

[22] Filed: May 17, 1993

[30] Foreign Application Priority Data

May 18, 1992 [JP] Japan ..... 4-032579 U
Oct. 16, 1992 [JP] Japan ..... 4-278317
Mar. 18, 1993 [JP] Japan ..... 5-058295

[51] Int. Cl.[6] ..... H01R 9/09

[52] U.S. Cl. ..... 439/259; 439/75; 439/140; 439/342

[58] Field of Search ..... 439/74, 75, 259, 342, 439/140, 141

[56] References Cited

U.S. PATENT DOCUMENTS

| | | | |
|---|---|---|---|
| 3,588,785 | 6/1971 | Hardardt | 439/249 |
| 4,217,020 | 8/1980 | Holland | 439/342 |
| 4,512,621 | 4/1985 | Bethurum | 439/259 |
| 4,538,866 | 9/1985 | Johnson | 439/259 |
| 4,540,229 | 9/1985 | Madden | 439/261 |
| 5,217,383 | 6/1993 | Hildebrandt | 439/259 |

FOREIGN PATENT DOCUMENTS 142309 12/1989 Japan .

*Primary Examiner*—Neil Abrams
*Attorney, Agent, or Firm*—Laff, Whitesel, Conte & Saret, Ltd.

[57] ABSTRACT

In a connector for connecting a pair of connection objects (60) having electroconductive inner surfaces or sockets (63). A long pin contact (10) is made of an electroconductive elastic material. Opposite ends of the pin contact are brought into a press contact with the inner surfaces or sockets (63), with a resulting elastic deformation of a longitudinal intermediate portion of the pin contact. The connection objects are opposite to each other in a first direction (Y) and have a relative position changeable between a first and a second position in a second direction (X) which is perpendicular to the first direction. Before the connection is carried out, the opposite ends of the pin are inserted into opposed spaces, respectively. The opposite ends are loosely fitted in the spaces when the relative position is the first position. When the relative position is changed from the first position to the second position, each of the opposite ends is brought into a press contact in first and the second directions with each of two points.

25 Claims, 26 Drawing Sheets

ELECTRICAL CONNECTOR HAVING A PLURALITY OF CONTACT PIN SPRINGS

BACKGROUND OF THE INVENTION

This invention relates to a connector for use in electrically connecting a pair of connection objects opposite to each other in a first direction and, in particular, to a connector which can carry out connection and disconnection between the connection objects in accordance with a relative movement of the connection objects in a second direction perpendicular to the first direction.

For example, a conventional connector of the type is disclosed in Japanese Utility Model Publication No. 42309/1989. The connector is for electrically connecting two pin contacts to each other and includes an electroconductive socket contact. The socket contact has two socket portions each having a size that allows insertion of the pin contact with a gap, and a flexible elastic portion connecting these socket portions.

Prior to electrical connection, the pin contacts are inserted into the respective socket portions. In this event, no special force is required for insertion of the contacts since each socket portion has such a size that allows insertion of the pin contact with a gap. Accordingly, the conventional connector will be called a zero-insertion-force connector.

Next, two pin contacts are moved in a radial direction in reverse to each other. The socket portions are brought into press contact with the pin contacts with the flexible elastic portions bent. As a result, two pin contacts are electrically connected through the socket contact.

However, the above-mentioned connector uses the socket contact including two socket portions connected through the flexible elastic portion and therefore has a complicated structure. In case of a high-density small-sized connector widely used in recent years, assembling of the socket contact is difficult and productivity is therefore decreased.

In order to assure insertion of the pin contacts into the socket portions, a positioning member is essential to place the socket portions at preselected positions. It is generally difficult to install the positioning member because of a complicated structure of the socket portions. This will readily be understood in view of the fact that the connector disclosed in the above-referenced publication comprises no positioning member. Accordingly, the socket portions may suffer from misalignment. In this event, the pin contacts fail to be inserted into the socket portions. This results in defective connection.

SUMMARY OF THE INVENTION

It is therefore an object of this invention to provide a zero-insertion-force connector which is simple in structure and which is improved in productivity.

It is another object of this invention to provide a zero-insertion-force connector which reduces a risk of defective connection.

According to this invention, there is provided a connector for use in connecting a pair of connection objects to each other, the connection objects being opposite to each other in a first direction and having a relative position changeable between a first and a second position in a second direction perpendicular to the first direction, the connection objects having inner surfaces which are electroconductive and extend in the first direction to define spaces, respectively. The connector comprises a pin contact of an electroconductive elastic material. The pin contact extends substantially in the first direction and has longitudinal opposite ends adapted to be inserted into the spaces, respectively, on connecting the connection objects to each other. The opposite ends are loosely fitted in the spaces when the relative position is the first position. Each of the opposite ends is brought into press contact with each of the inner surfaces at a plurality of points different in the first and the second directions with the pin contact having a longitudinal intermediate portion which is between the opposite ends and is elastically deformed when the relative position is changed from the first position to the second position.

DESCRIPTION OF THE PREFERRED EMBODIMENTS

First Embodiment

Figure 1:
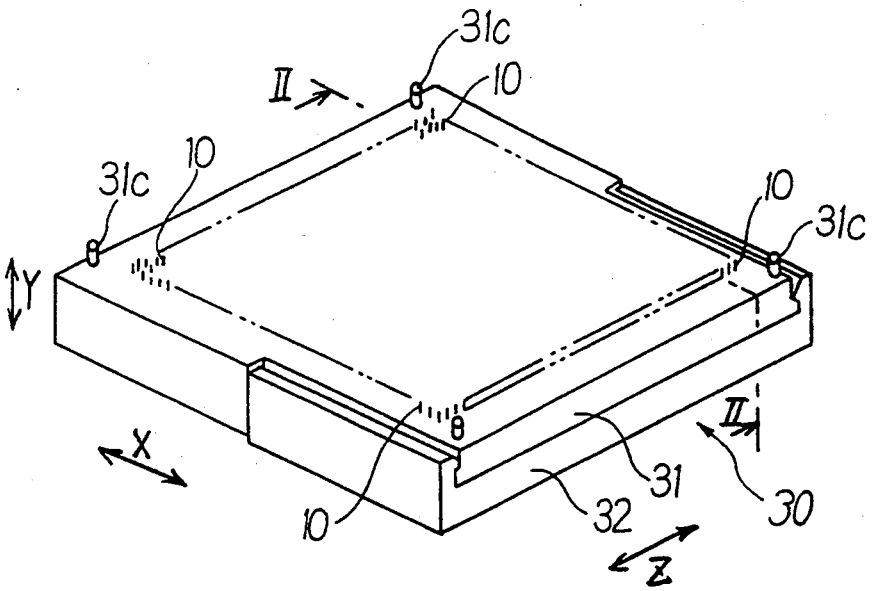
FIG. 1 is a perspective view of a connector according to a first embodiment of this invention.
Figure 2:
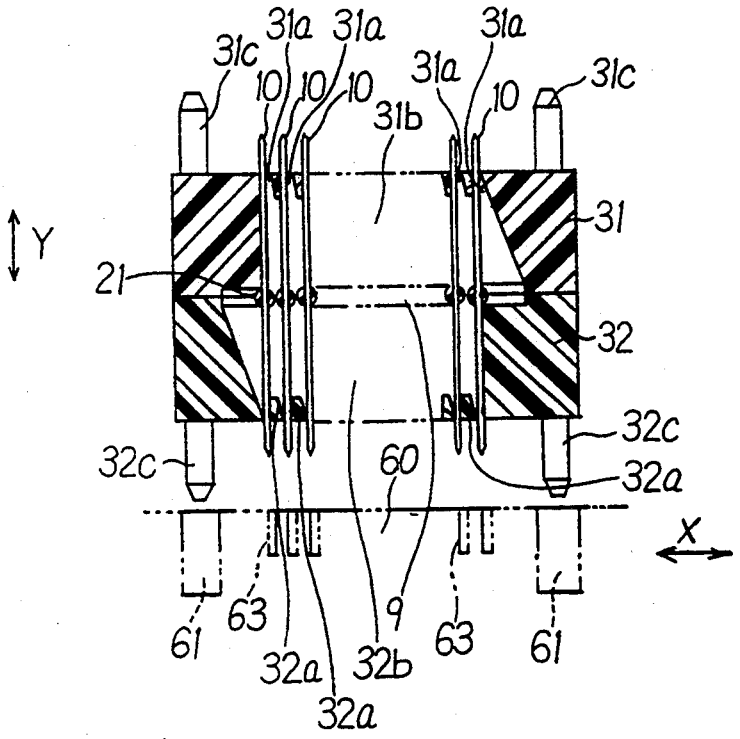
FIG. 2 is a sectional view taken along a line II—II of FIG. 1, in which the connector is on a disconnection state.

FIGS. 1 and 2 show a connector according to a first embodiment of this invention. The connector comprises a housing member 30 for accommodating a plurality of pin contact units which will later be described. The housing member 30 comprises an upper insulation housing 31 and a lower insulation housing 32 which have meeting surfaces opposite to each other in a first direction Y. For convenience of illustration, a connection object 60 is illustrated only at the side of the lower insulation housing 32. As best shown in FIG. 2, the insulation housings 31 and 32 are provided at the meeting surfaces with spaces 31*b* and 32*b* for accommodating the pin contact units. On the opposite surfaces, positioning holes 31*a* and 32*a* are formed with a predetermined space apart from one another for insertion and hold of individual pin contacts 10 which are included in the pin contact units. Each of the pin contacts 10 is of an electroconductive elastic material. The positioning holes 31*a* and 32*a* communicate with the spaces 31*b* and 32*b*.

Figure 3:
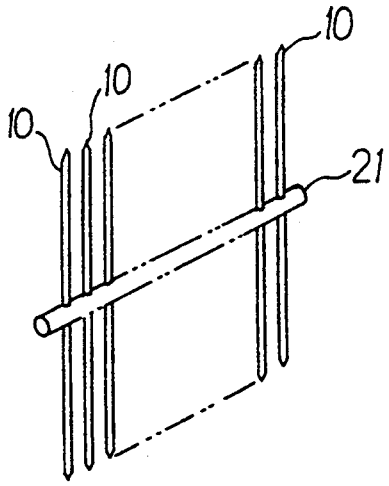
FIG. 3 is a perspective view of an example of a pin contact unit included in the connector of FIG. 1.

FIG. 3 is a perspective view illustrating one example of the pin contact units included in the connector that is illustrated in FIGS. 1 and 2. The pin contact units 2 are formed in the manner which will presently be described. After a plurality of the pin contacts 10 are arranged in parallel with a predetermined space apart from one another, the pin contacts 10 are fixedly held at their center portions by a bridge member 21 having a general circular section and made of an insulating resin material. As a result, each of the pin contact units forms a comb-like pin contact array.

Returning back to FIGS. 1 and 2, the pin contact units are juxtaposed in a second direction X perpendicular to the first direction Y and assembled into the insulation housings 31 and 32. Consequently, the pin contacts 10 of each of the pin contact units are arranged along a third direction Z perpendicular to the first and the second directions Y and X. Thus, a large number of the pin contacts 10 are arranged in a predetermined matrix fashion in a horizontal plane defined by the second and the third directions X and Z. For simplification of the drawing, only several ones of each of the pin contacts 10, the positioning holes 31*a* and 32*a* are shown in the drawings while the remaining ones being indicated by imaginary lines.

In order to achieve an ultra-high-density arrangement, each of the pin contacts 10 is made of an electroconductive elastic stick member with acute opposite ends and a circular cross-section. Each of the pin contacts 10 may have acute opposite ends and a rectangular cross-section. It is noted here that the pin contacts 10 are not restricted to the above-mentioned configuration and may be an elongated plate having acute opposite ends. The pin contacts 10 can be manufactured from a linear material or from a plate material through pressing or etching. The manufacturing method is not restricted at all.

The insulation housings 31 and 32 are provided at the meeting surfaces with elongated grooves 9 formed on the opposite wall surfaces of the spaces 31*b* and 32*b*. The elongated grooves 9 engage and receive the opposite ends of the bridge member 21 when the insulation housings 31 and 32 meet each other. Thus, the bridge member 21 fixedly holds the pin contacts 10 and is engaged between the upper and the lower insulation housings 31 and 32 while the pin contact units are accommodated in the spaces 31*b* and 32*b*. Accordingly, the pin contacts 10 can not be slipped out from the upper and the lower sides of the housing member 30. The spaces 31*b* and 32*b* have a size and a configuration such that collision and resultant distortion of the pin contacts 10 is not caused to occur when the insulation housings 31 and 32 are relatively moved in the second direction X. The elongated grooves 9 allow slight displacement of the bridge member 21 in the second direction X when the insulation housings 31 and 32 are relatively moved in the same direction. Thus, each of the pin contacts 10 is elastically deformed symmetrically with respect to the longitudinal center portion thereof.

Each of the upper and the lower insulation housings 31 and 32 is provided with positioning pins 31*c* and 32*c* formed at predetermined locations on the external surface, for example, at corners as illustrated in the figure. The positioning pins 31*c* and 32*c* are to be inserted into positioning holes 61 formed on the connection object 60. Preferably, each of the positioning pins 31*c* and 32*c* has a height greater than the projecting length of each of the pin contacts 10 projecting from the insulation housings 31 and 32.

The connection object 60 is a selected one of a mating connector, an LSI (a large scale integrated circuit), and a circuit board and comprises a socket contacts 63. The socket contacts 63 are arranged corresponding to the predetermined matrix fashion but only several ones are also shown for the purpose of simplification while the remaining ones being indicated by imaginary lines. Each of the socket contacts 63 has an electroconductive internal surface extending in the first direction Y and defining a space. Specifically, the socket contact 63 is plated at the inner surface of the space with an electroconductive material. In case where the connection object 60 is a circuit board, a plurality of through holes are formed to the circuit board and plated at the inner surfaces of the through holes with an electroconductive material.

Figure 4:
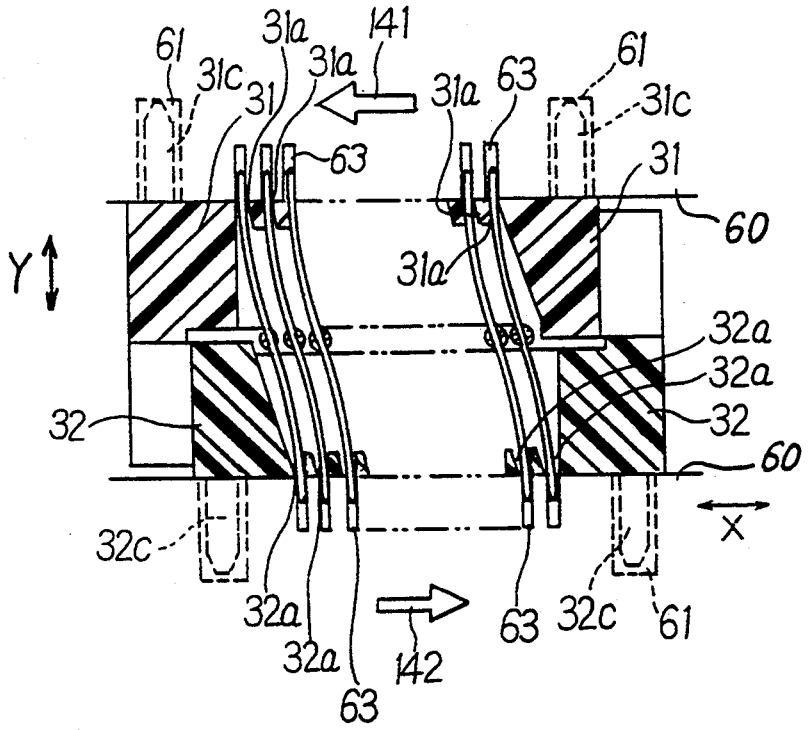
FIG. 4 is a sectional view similar to FIG. 2, in which the connector is on a connection state.

Referring to FIG. 4 in addition to FIGS. 1 and 2, the description will be directed to connection between a pair of connection objects 60. At first, the connection objects 60 are placed at the upper and the lower sides of the housing member 30, respectively. The longitudinal opposite ends of the pin contacts 10 are inserted into the socket contacts 63 of the upper and the lower connection objects 60. In this state, the upper and the lower connection objects 60 can be located at a relative position variable between a first position and a second position along the second direction X. When the relative position is the first position, the opposite ends of the pin contacts 10 are loosely fitted to the socket contacts 63. When the connection objects 60 are arranged at the upper and the lower sides of the housing member 30 while the relative position is the first position, it is possible to reduce an insertion force required to insert the pin contacts 10 into the socket contacts 63. In this state, the pin contacts 10 and the socket contacts 63 are put in unstable contact.

Next, the upper and the lower insulation housings 31 and 32 are horizontally relatively moved in the second direction X as depicted by white arrows 141 and 142 to obtain the state illustrated in FIG. 4. In FIG. 4, the relative position is the second position. Each of the opposite ends of the pin contacts is brought into press contact with the internal surface of the socket contact 63 at two different points different in the first direction Y and in a radial direction while a longitudinal intermediate portion of the pin contact is elastically deformed. As a result, a predetermined connection is obtained between the connection objects 60.

Figure 5:
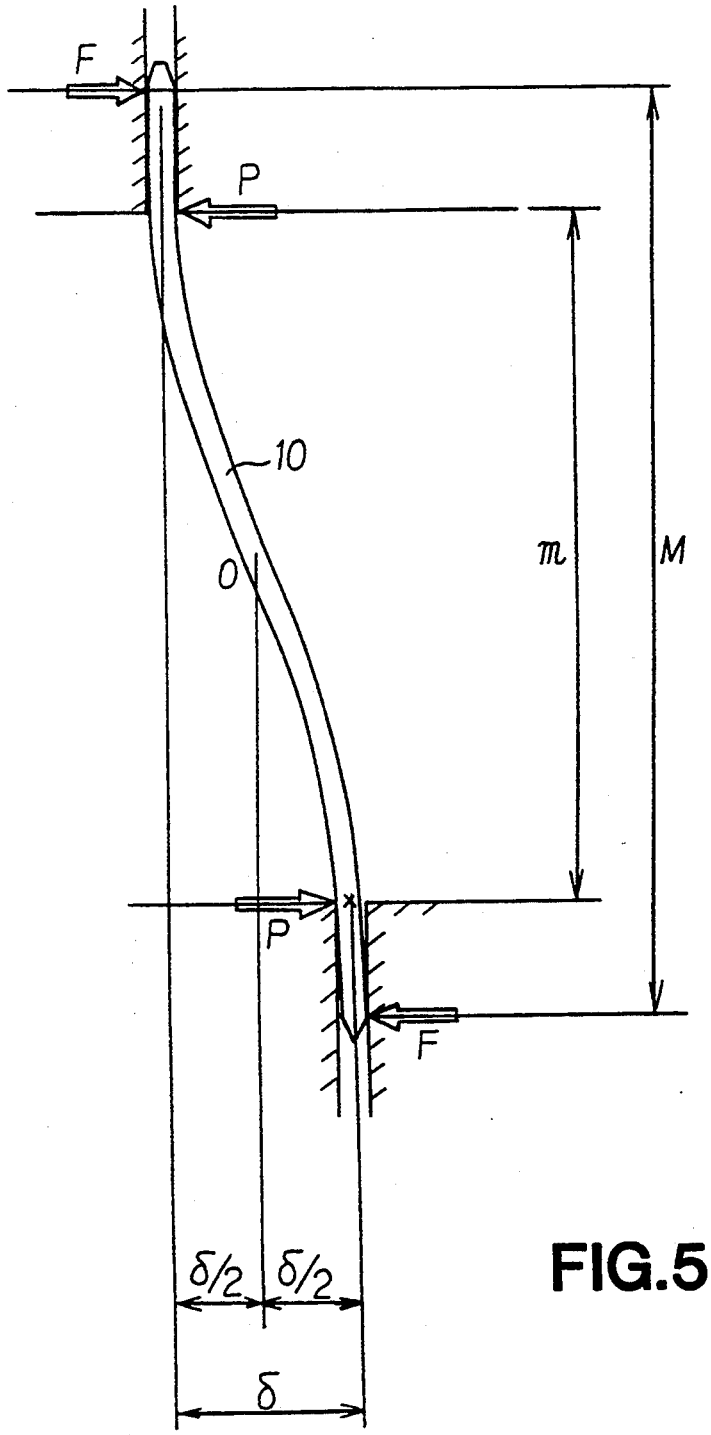
FIG. 5 is a schematic diagram for use in describing a state of a pin contact included in the connector that is on the connection state of FIG. 4.

FIG. 5 shows deformation of the pin contact 10 in the state illustrated in FIG. 4. The relationship between contact forces P and F at each of the opposite ends of the pin contact 10 is represented by:

$$P \times m = F \times M.$$

The operation force W for relative movement is calculated by:

$$W = P - F = P - (m/M)P = (M - m)/M \times P.$$

When $(M-m) << M$, the operation force W is considerably reduced.

As will readily be understood, it is desirable that the upper and the lower parts of the pin contact 10 are completely symmetrically deformed with respect to a longitudinal center point 0. Let the displacement of the insulation housings 31 and 32 be represented by $\delta$. In this event, the point 0 is shifted by $\delta/2$.

Second Embodiment

Figure 6:
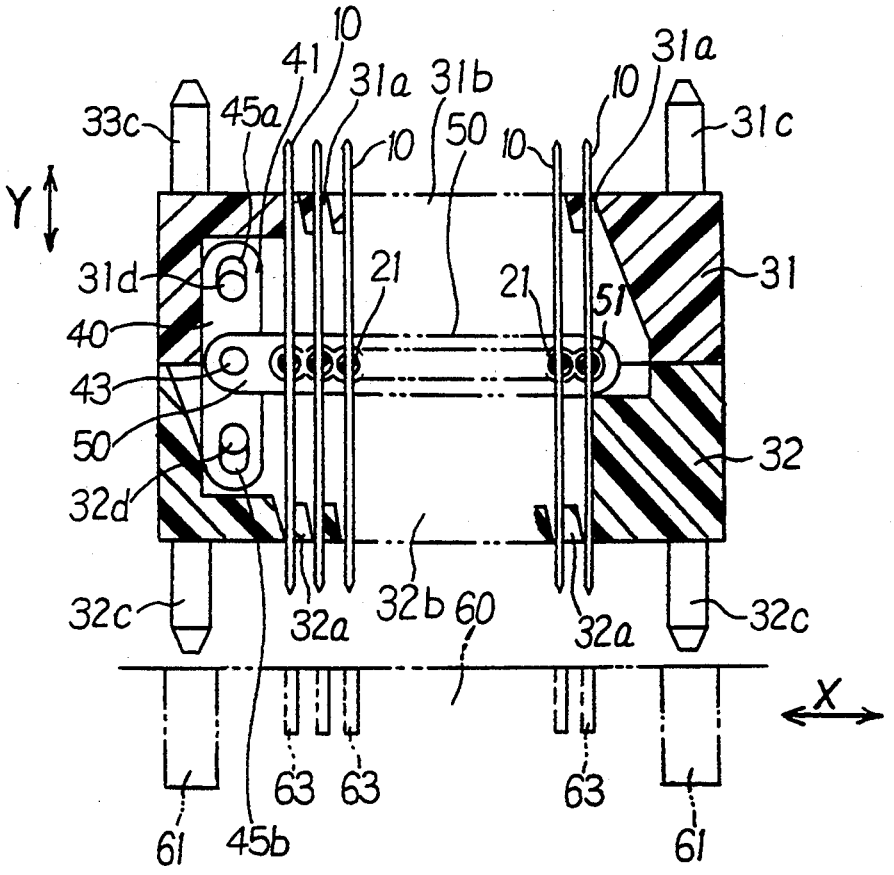
FIG. 6 is a sectional view of a connector according to a second embodiment of this invention, in which the connector is on the disconnection state.
Figure 7:
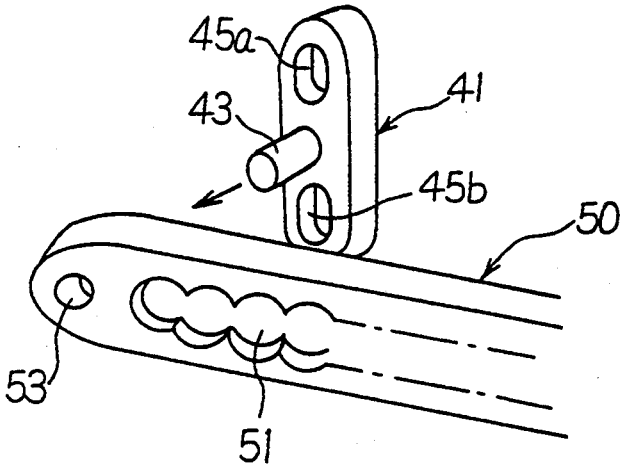
FIG. 7 is a perspective view of a holding member and a link plate which are included in the connector of FIG. 6.
Figure 8:
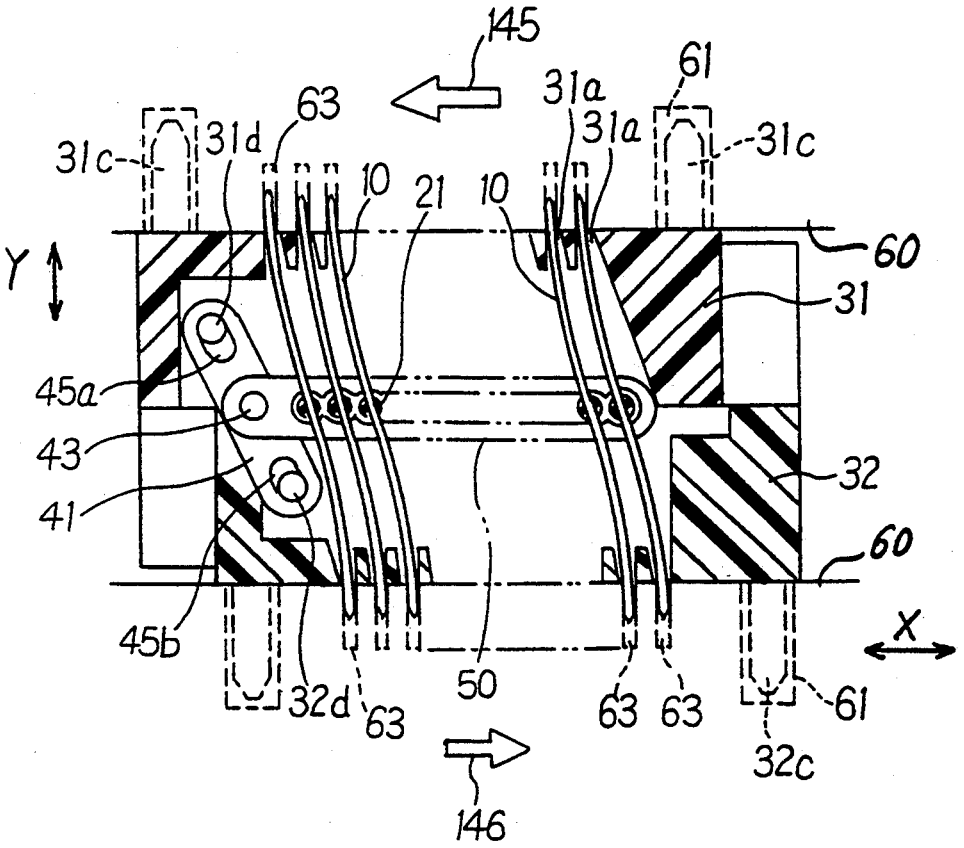
FIG. 8 is a sectional view similar to FIG. 6, in which the connector is on the connection state.

FIGS. 6, 7, and 8 show a connector according to a second embodiment of this invention. Similar parts are designated by like reference numerals. The connector further comprises the holding member 50 and a link plate 41. The holding member 50 has a holding groove 51 which is formed by a series of circular holes communicating with one another and which extends in a longitudinal direction. Only several circular holes are shown in the figures for the purpose of simplification of the drawing while the remaining ones being indicated by imaginary lines. Each bridge member 21 has a center axis extending in the third direction and held in the holding groove 51 of the holding member 50 to be rotatable around the center axis.

The holding member 50 is movable between the insulation housings 31 and 32 in the second direction X and has an end portion provided with a pin engagement hole 53. The pin engagement hole 53 is for insertion and engagement of a pin 43 projecting from one surface of the link plate 41. The link plate 41 is provided with a pair of elongated holes **45*a* and 45*b* in the vicinity of the opposite ends thereof. The elongated holes 45*a* and 45*b* are engaged with pins 31*d* and 32*d* formed on the inner wall surfaces of the spaced 31*b* and 32*b* in the insulation housings 31 and 32. A combination of the link plate 41, the pins 31*d* and 32*d*, and the pin 43** will be referred to as a link mechanism.

When the insulation housings 31 and 32 are relatively moved in the second direction X after the connection objects 60 are placed on the insulation housings 31 and 32, the predetermined connection is obtained as shown in FIG. 8. Even when the insulation housings 31 and 32 are moved in directions depicted by arrows 145 and 146, the holding member 50 and the bridge member 21 (namely, the center point 0 of the pin contact as illustrated in FIG. 5) are substantially kept in a stationary state. Accordingly, each of the pin contacts 10 is deformed in a desired configuration in which the upper and the lower parts are completely symmetrical with respect to the center point 0. In other words, the intermediate portion of each of the pin contacts 10 is elastically deformed symmetrically with respect to the longitudinal center portion. As a result, the predetermined connection is favorably obtained.

Figure 9:
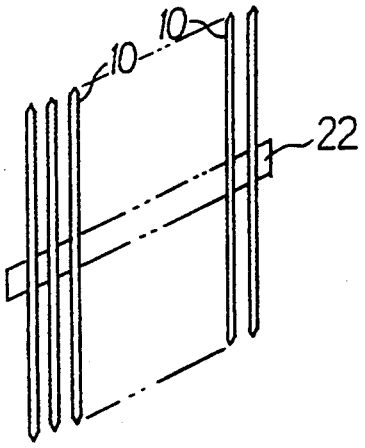
FIG. 9 is a perspective view of another example of the pin contact unit included in the connector of FIG. 1.

FIG. 9 shows another example of each of the pin contact units which will be formed as follows. After the pin contacts 10 are arranged at a predetermined space apart from one another, the pin contacts 10 are fixedly held at their center portions by a bridge member 22 of a plastic film instead of the bridge member 21 illustrated in FIG. 3. As a result, each of the pin contact units forms a comb-like contact array.

Figure 10:
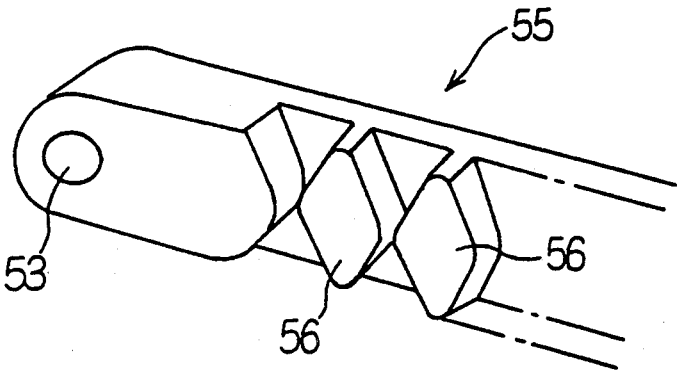
FIG. 10 is a perspective view of the holding member for use in holding the pin, contact unit of FIG. 9.

When the pin contact unit illustrated in FIG. 9 is used, a holding member 55 illustrated in FIG. 10 is used substituting for the holding member 50 illustrated in FIG. 7. The holding member 55 is provided with diagonal or elliptical projections 56 formed at a predetermined space apart from one another. Only several projections are shown in the figures for the purpose of simplification of the drawing while the remaining ones being indicated by imaginary lines.

Each of the pin contacts 10 is interposed between the projections 56 and inserted between the projections 56 at the side opposite to that fixed to the bridge member 22. Each projection 56 has a diagonal section as illustrated or an elliptical section so that the pin contacts 10 can be freely inclined. The holding member 55 is assembled into the insulation housings 31 and 32 in the manner similar to the holding member 50 in FIG. 8 and exhibits the similar effect.

Third Embodiment

Figure 11:
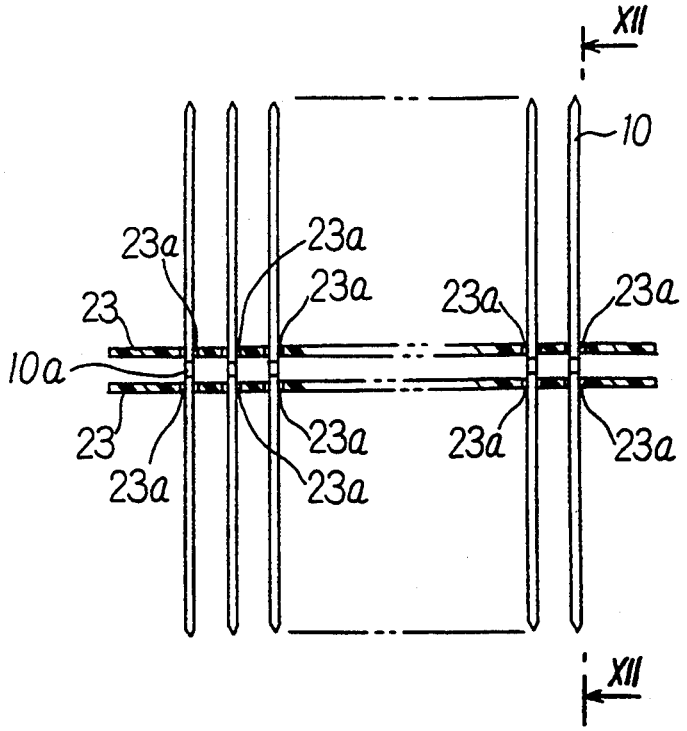
FIG. 11 is a sectional view of a pin contact unit included in a connector according to a third embodiment of this invention.
Figure 12:
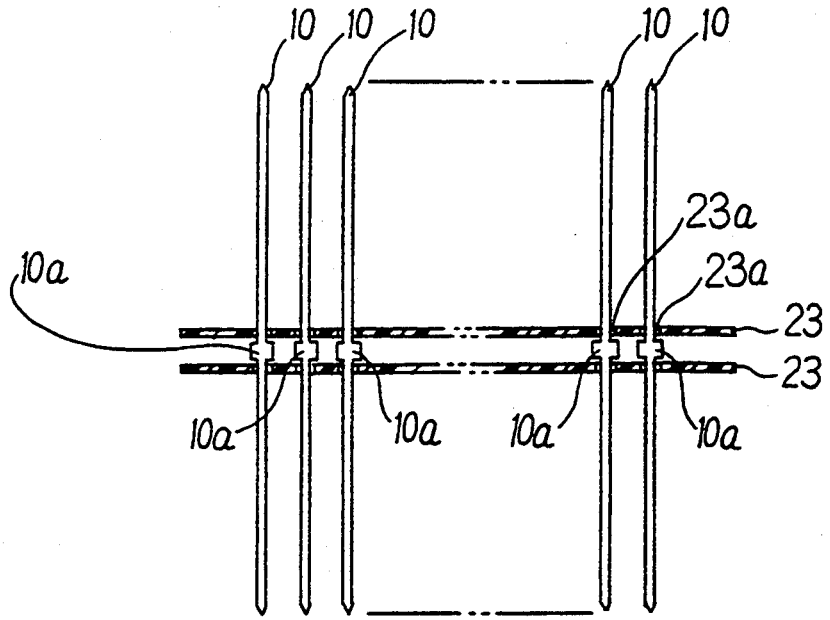
FIG. 12 is a sectional view taken along a line XII—XII of FIG. 11.

FIGS. 11 and 12 show a pin contact unit included in a connector according to a third embodiment of this invention. Similar parts are designated by like reference numerals. The pin contact unit comprises a plate-shaped insulator formed by two insulation plates 23 opposite to each other in the first direction Y with a space left therebetween. The pin contacts 10 are held by the plate insulator. Each insulation plate 23 has a plurality of through holes 23*a* in the predetermined matrix fashion for receiving the longitudinal intermediate portions of the pin contacts 10. Only several through holes are shown in the figures for the purpose of simplification of the drawing while the remaining ones being indicated by imaginary lines.

On the other hand, each pin contact 10 is enlarged in diameter at its center portion to form a flange portion 10*a* projecting in a direction intersecting the axial direction of the pin contact. The flange portion 10*a* is interposed between the insulation plates 23 and engaged therewith. Thus, each of the pin contacts 10 is prevented from being slipped off. In addition, it is possible to avoid misalignment of the top ends of the pin contacts 10.

Fourth Embodiment

Figure 13:
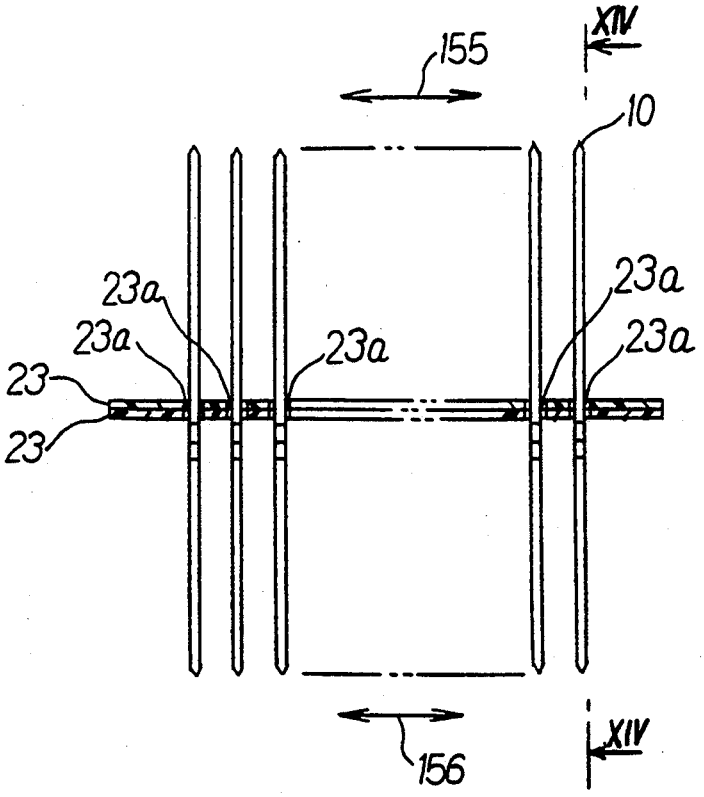
FIG. 13 is a sectional view of a pin contact unit included in a connector according to a fourth embodiment of this invention.
Figure 14:
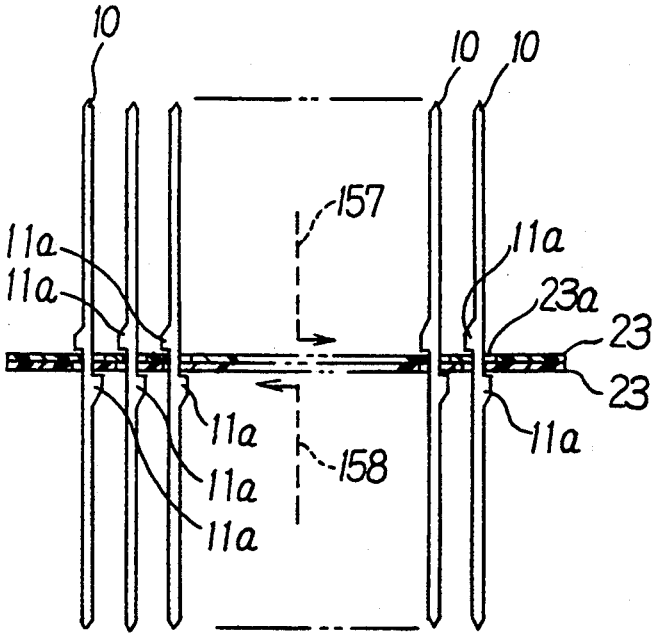
FIG. 14 is a sectional view taken along a line XIV—XIV of FIG. 13.

FIGS. 13 and 14 show a pin contact unit included in a connector according to a fourth embodiment of this invention. The pin contact unit comprises similar parts designated by like reference numerals. In the pin contact unit, each of the pin contacts 10 is provided in the vicinity of its center portion with two stepped portions 11*a* projecting in reverse to each other in a direction perpendicular to the axial direction. These stepped portions 11*a* are arranged at positions spaced from each other in the longitudinal direction of each of the pin contacts 10. Each stepped portion 11*a* has a size that allows passage through the through hole 23*a* of the insulation plate 23.

In order to hold the pin contacts 10, the through holes 23*a* of the insulation plates 23 of an identical shape are fitted between the stepped portions 11*a* of each of the pin contacts 10. Then, as depicted by dotted arrows 157 and 158 in FIG. 14, the insulation plates 23 are moved in reverse to each other and in reverse to the projecting directions of the stepped portions 11*a*. The insulation plates 23 are faced to the stepped portions 11*a* in the longitudinal direction of each of the pin contacts 10.

Fifth Embodiment

Figure 15:
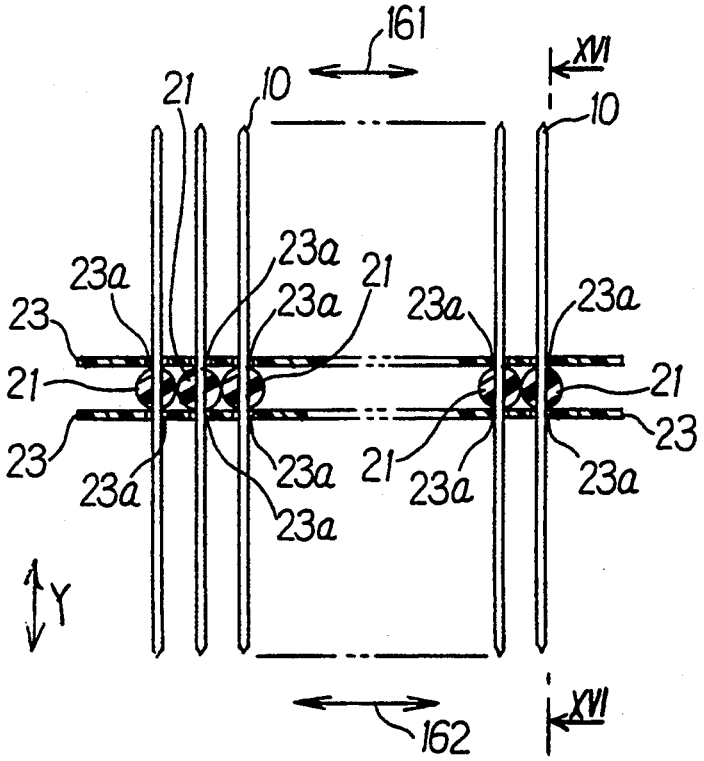
FIG. 15 is a sectional view of a pin contact unit included in a connector according to a fifth embodiment of this invention.
Figure 16:
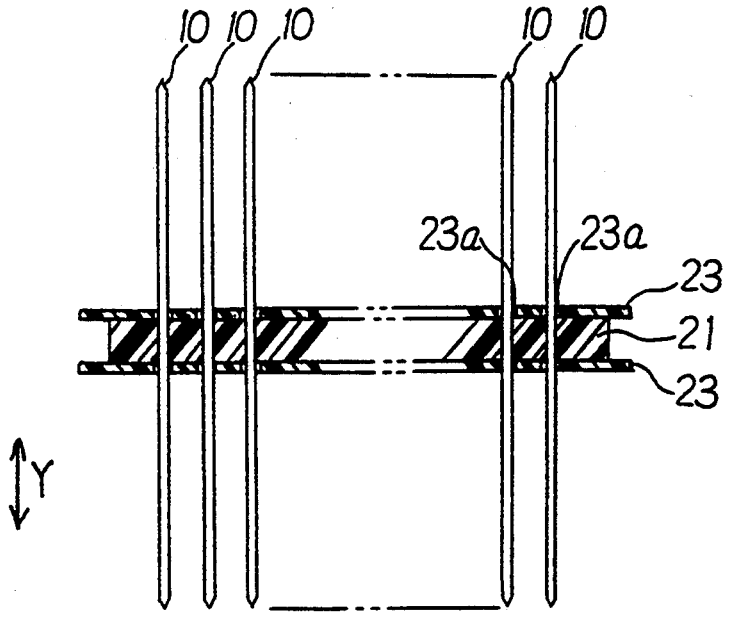
FIG. 16 is a sectional view taken along a line XVI—XVI of FIG. 15.

FIGS. 15 and 16 show a pin contact unit included in a connector according to a fifth embodiment of this invention. The pin contact unit comprises similar parts designated by like reference numerals.

The pin contacts 10 are provided at their axial center portions with the bridge members 21 each of which is similar to that illustrated in FIG. 3. The through holes 23*a* are formed on each of the insulation plates 23 and are fitted to the pin contacts 10 through the opposite ends thereof. The insulation plates 23 are faced to each other in the first direction Y. As a result, the bridge members 21 are interposed between the insulation plates 23 so that the center portions of the pin contacts 11 are held by the insulation plates 23. Thus, the pin contacts 10 are maintained at predetermined positions.

The pin contact units according to the above-mentioned third through the fifth embodiments are also held in a pair of the insulation housings in the manner similar to the connector according to the first embodiment. By relative movement of the insulation housings, the pin contacts 10 are deformed in the manner similar to that described in the first embodiment.

Sixth Embodiment

Figure 17:
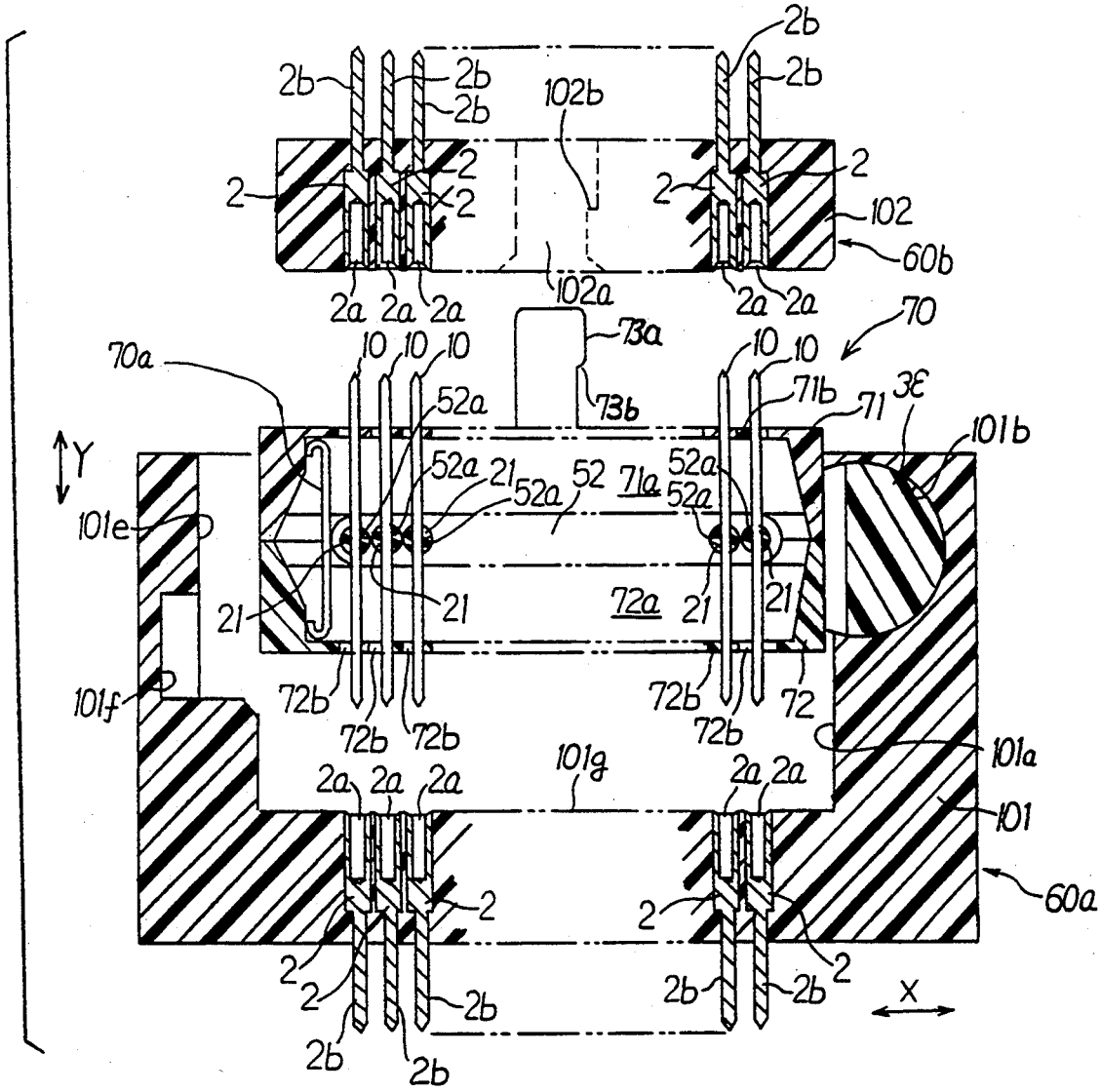
FIG. 17 is a sectional view of a connector according to a sixth embodiment of this invention, in which the connector is on the disconnection state.
Figure 18:
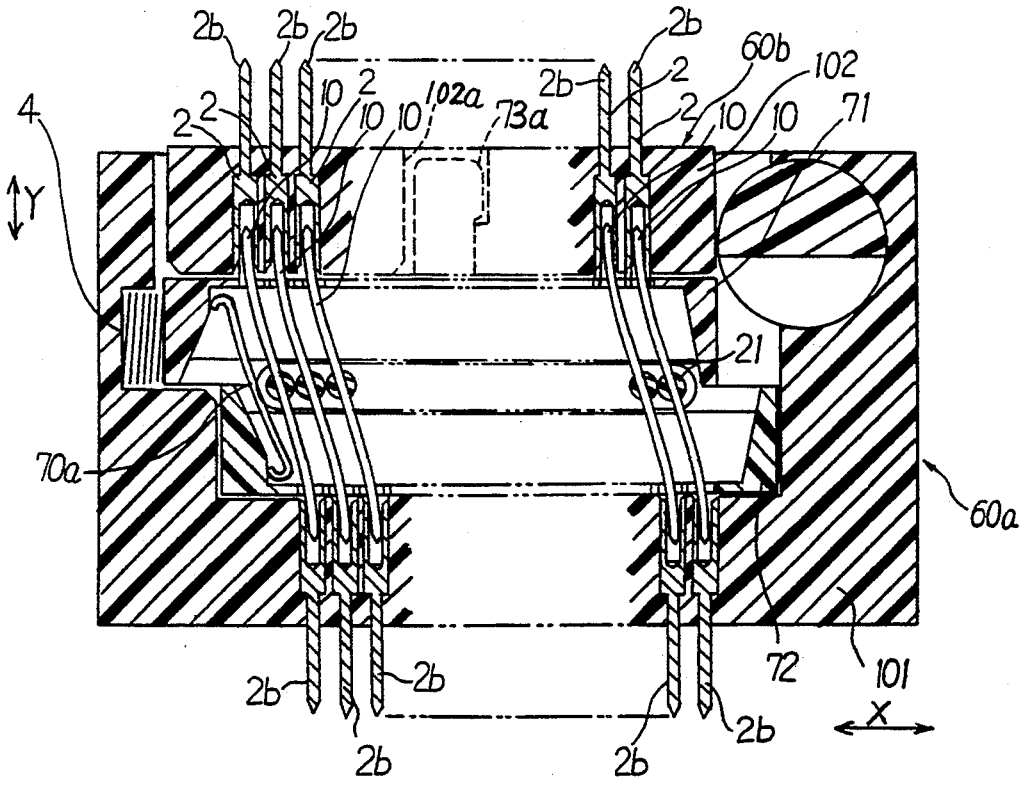
FIG. 18 is a sectional view similar to FIG. 17, in which the connector is on the connection state.

FIGS. 17 and 18 show a connector according to a sixth embodiment of this invention together with first and second mating connectors 60*a* and 60*b* as the connection objects. Similar parts are designated by like reference numerals.

The first-mentioned connector comprises a housing member 70 including upper and lower insulation housings 71 and 72 meeting to each other for holding the pin contacts 10. Each of the contacts 10 has end parts which project from the upper and the lower sides of the housing member 70, respectively. The first mating connector 60*a* includes a plurality of socket contacts 2 each for connecting to an end of each of the pin contacts 10, and an insulation socket 101 for holding the socket contacts 2. The second mating connector 60*b* includes a plurality of the socket contacts 2 each for connecting to another end of each of the pin contacts 10, and an insulation plug 102 for holding the socket contacts 2. Only several socket contacts are shown in the figures for the purpose of simplification of the drawing while the remaining ones being indicated by imaginary lines.

The upper and the lower insulation housings 71 and 72 are hollow cases having opposite open surfaces. Standing walls 71*a* and 72*a* are lower than the contact surfaces so as to define a space which receives a holding member 52 holding the pin contacts when the open surfaces are matched together. The insulation housings 71 and 72 are provided at their exterior surfaces with a plurality of through holes, namely, positioning holes 71*b* each having a diameter greater than than at of each of the pin contacts 10 accommodated therein. Only several ones of the positioning holes 71*b* are shown in the figures for the purpose of simplification of the drawing while the remaining ones being indicated by imaginary lines.

The holding member 52 has an elongated plate shape and is provided with a plurality of circular holes 52*a* spaced from one another in correspondence to the pin contacts 10 for rotatably supporting the bridge member 21 of each of the pin contact units. The upper insulation housing 71 is provided at the center of the upper surface with a positioning pin 73*a* having a stepped portion 73*b* and projecting from the upper insulation housing 71 in the first direction Y.

At one side of the space inside the housing member 70, an offset spring 70*a* having opposite ends rounded in the same direction is inserted with the rounded opposite ends kept in contact with one internal walls of the insulation housings 71 and 72. The offset spring 70*a* urges one end of the holding member 52 towards the other internal wall of the housing member 70 so that the pin contacts 10 are brought to the one sides of the through holes 71*b* and 72*b* with top ends thereof aligned.

The insulation socket 101 has a receiving hole 101*a* opened upwards to receive the housing member 70. The receiving hole 101*a* has one side wall provided with a circular hole 101*b*. A drive cam 38 has a cut-off part corresponding to an arc slightly smaller than a semi circle and is rotatably mounted within the hole 101*b*. The receiving hole 101*a* has the other side wall, opposite to the one side wall, provided with a recess 101*e* outwardly depressed deeper than the width of the insulation housings 71 and 72 and with a return spring receiving hole 101*f* outwardly depressed in the socket 101 far deeper than the recess 101*e*. As will later be described, the spring receiving hole 101*f* accommodates a coil spring, namely, a return spring 4 which urges one insulation housing 71 of the housing member 70 towards the other end (rightwards in the figure) of the receiving hole 101*a* of the housing.

The socket contacts 2 have openings 2*a* aligned at a bottom 101*g* of the receiving hole 101*a* while one ends 2*b* thereof project through the bottom wall outwardly of the external wall surface. The housing member 70 is received in the receiving hole 101*a* of the insulation socket 101. At this time, the lower ends of the pin contacts 10 are inserted into the socket contacts 2 held by the insulation socket 101. The coil spring 4 is accommodated in the spring receiving hole 101*f*. The coil spring 4 serves to urge the upper insulation housing 71 rightwardly along the surface of the drawing sheet and to return the insulation housing 71 to the initial position after the socket 2 is released.

In the insulation plug 102, the socket contacts 2 are arranged with their openings 2*a* aligned at the facing surface faced to the pin contacts 10 and the other ends 2*b* projected from the other surface opposite to the facing surface. The insulation plug 102 is provided with a guide hole 102*a* for receiving the positioning pin 71*c*. The guide hole 102*a* is provided with a stepped portion 102*b* to be engaged with the stepped portion 71*d* of the positioning pin 71*c*.

The insulation plug 102 is also received in the receiving hole 101*a* of the insulation socket 101. At this time, the positioning pin 71*c* is inserted into the guide hole 102*b*. At the initial stage of insertion, the pin contacts 10 are biased to one sides of the through holes 71*b* and have center lines coincident with those of the socket contacts 2. Accordingly, the pin contacts 10 are smoothly inserted into the socket portions 2*a* of the socket contacts 2. After completion of insertion, the insulation housing 71 and the insulation plug 102 are moved leftwardly of the surface of the drawing sheet. By operation of the positioning pin 71*c* and the stepped portions 71*d* and 102*b* in the guide hole 102*a*, the insulation housing 71 is moved by a distance slightly shorter than that of the insulation plug 102. Consequently, the pins 10 which have been biased to the one sides of the through holes 71*b* are located at substantial centers of the through holes 71*b*.

Next, as illustrated in FIG. 18, the drive cam 38 is rotated to move the insulation housing 71 and the insulation plug 102 leftwardly along the surface of the drawing sheet. As a result, the contact force is obtained between the pin contacts 10 and the socket contacts 2 with deformation of the pin contacts 10 as illustrated in the figure.

Seventh Embodiment

Figure 19:
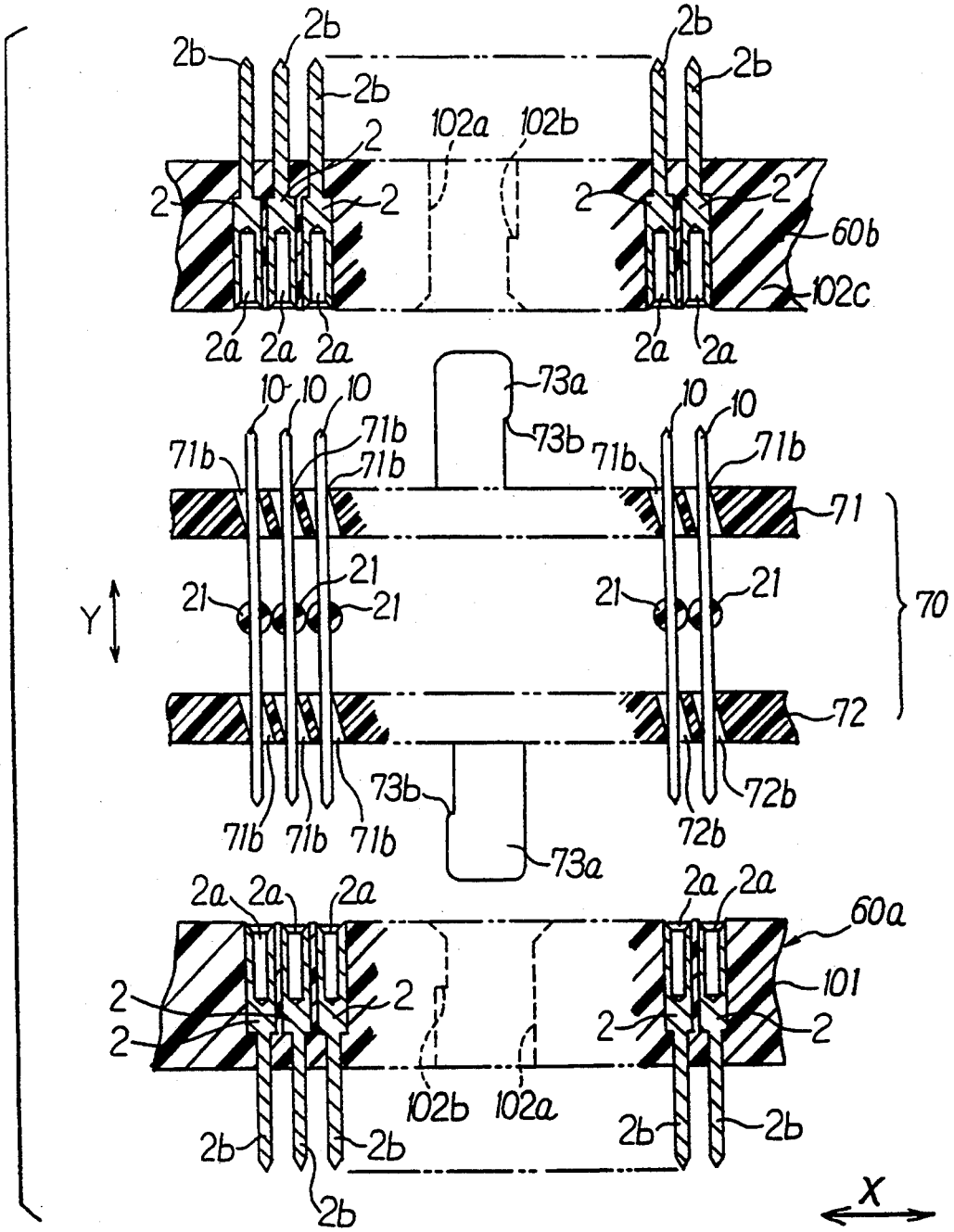
FIG. 19 is a sectional view of a part of a connector according to a seventh embodiment of this invention, in which the connector is on the disconnection state.
Figure 20:
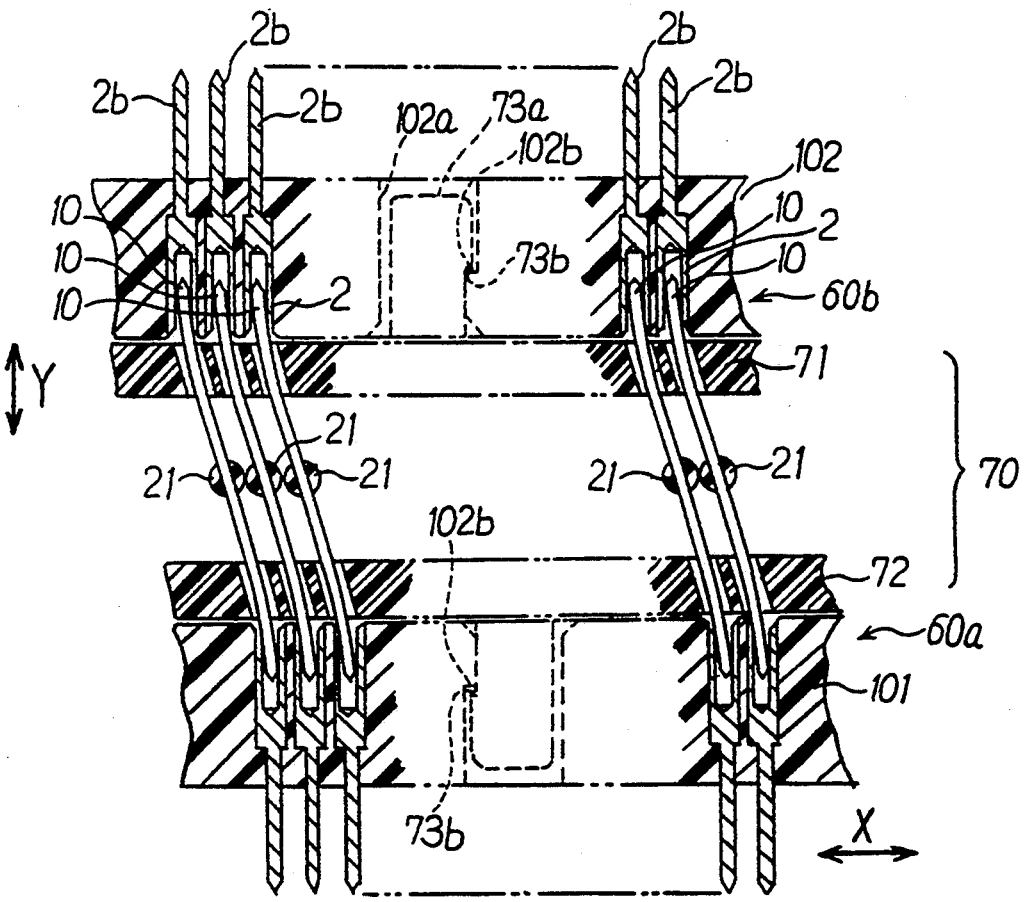
FIG. 20 is a sectional view similar to FIG. 19, in which the connector is on the connection state.

FIGS. 19 and 20 show a main portion of a connector according to a seventh embodiment of this invention. Similar parts are designated by like reference numerals. Although not shown in the figure for brevity of description, the connector comprises a housing member, a return spring, and a drive cam, like the connector that is illustrated in FIGS. 17 and 18.

As illustrated in FIG. 19, the insulation housings 71 and 72 are provided with the positioning holes 71*b* and 72*b* inclined in a single direction, for example, to the left in the figure at the same angle with respect to the first direction Y. Each of the positioning holes 71*b* and 72*b* has a diameter such that upper and lower acute edges thereof are brought into contact with the pin contact 10.

The lower mating connector 60*a* has a structure similar to that of the upper mating connector 60*b*. The lower insulation housing 72 has a positioning pin 73*a* inserted into the guide hole 102*a* of the insulation socket 101. The stepped portion 73*b* and the stepped portion 102*b* are engaged in the first direction Y. The pin contacts 10 are positioned at the center portions of the socket contacts 2. Thus, an integral assembly is obtained which comprises the insulation socket 101 and the housing member 70. Generally, the integral assembly is dealt with as one unit component while the upper socket 102 is dealt with as another unit component. The integral assembly of the housing member 70 and the insulation socket 101 is fitted to the upper socket. As illustrated in FIG. 20, the drive cam is driven to provide relative movement in the second direction X so that a contact force is produced between the pin contacts 10 and the socket contacts 2.

Eighth Embodiment

Figure 21:
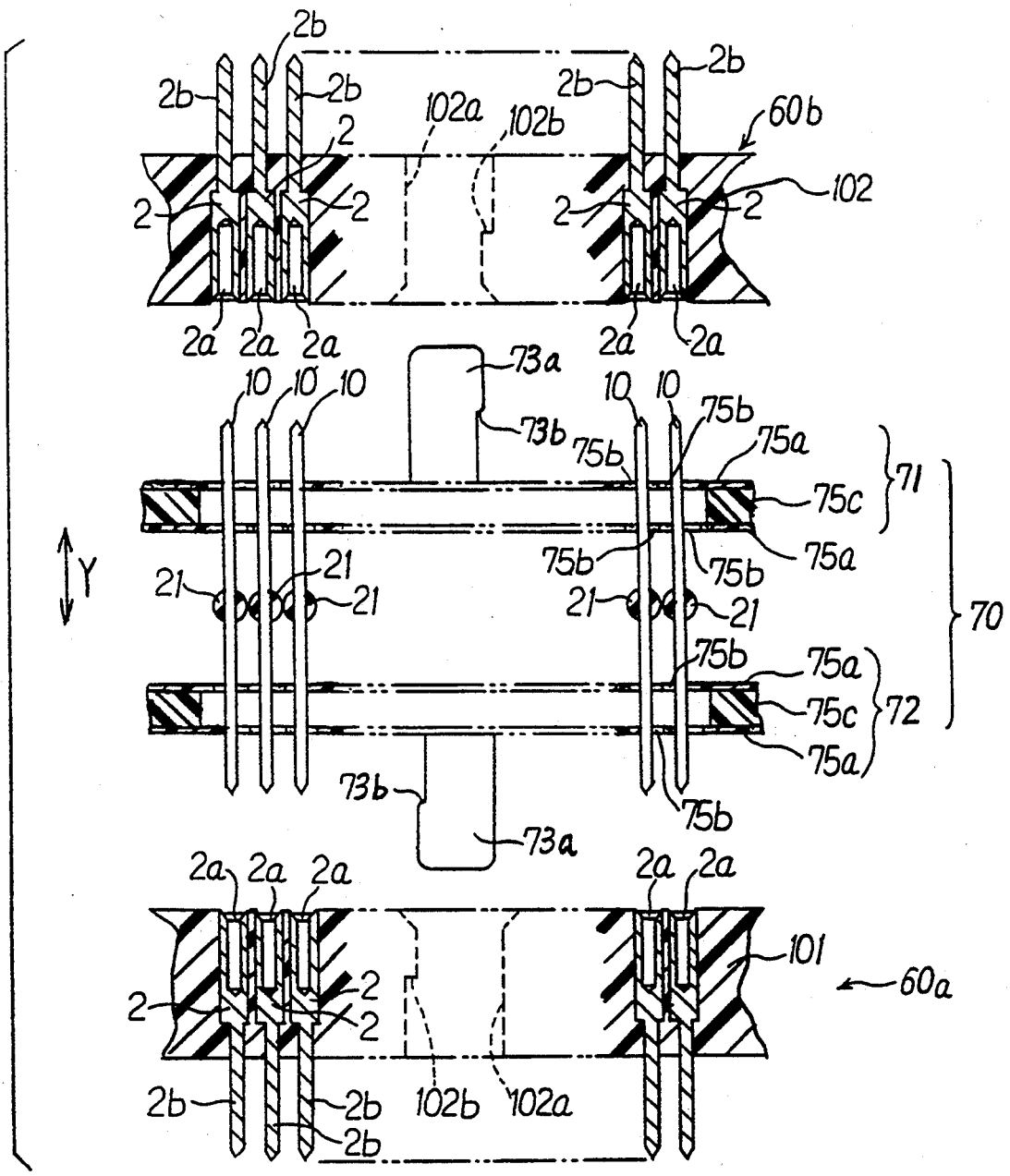
FIG. 21 is a sectional view of a part of a connector according to an eighth embodiment of this invention, in which the connector is on the disconnection state.
Figure 22:
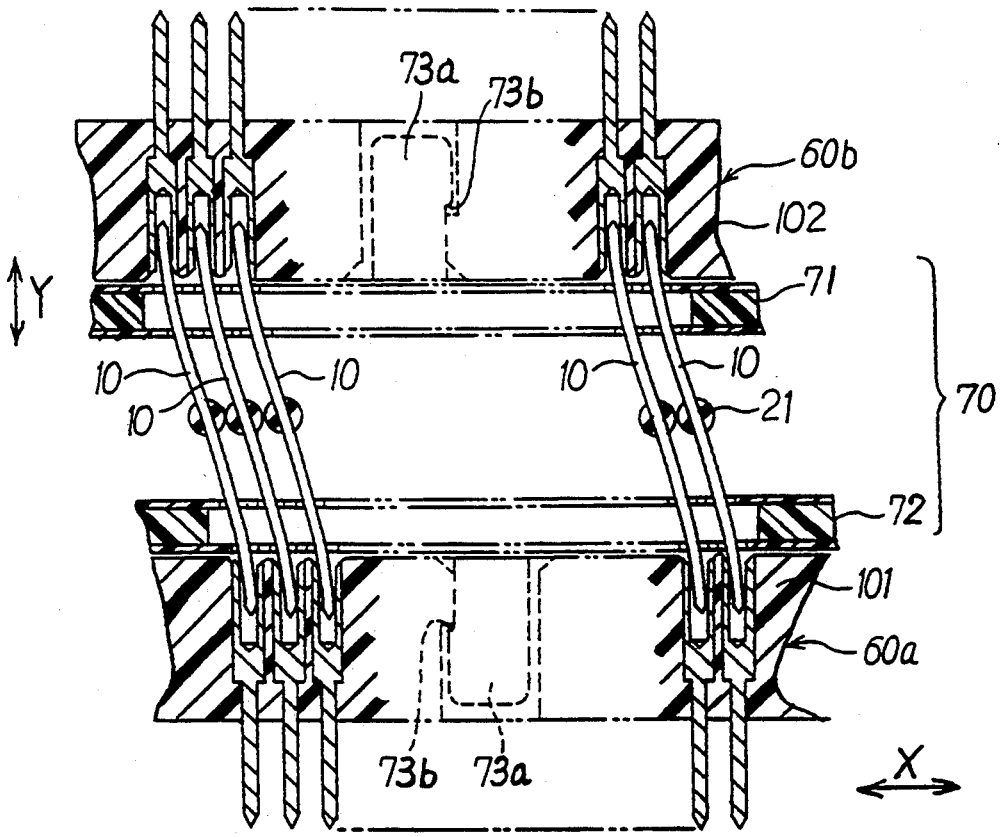
FIG. 22 is a sectional view similar to FIG. 21, in which the connector is on the connection state.

FIGS. 21 and 22 show a main portion of a connector according to an eighth embodiment of this invention. The connector comprises similar parts designated by like reference numerals. Although not shown in the figure for brevity of description, the connector comprises a housing member, a return spring, and a drive cam, like the connector that is illustrated in FIGS. 17 and 18.

In the connector, each of the insulation housings 71 and 72 comprises two parallel insulation films 75*a* and resin molds 75*c* filled and solidified between the insulation films 75*a* at both ends thereof. The insulation films 75*a* of each of the insulation housings 71 and 72 are provided with alignment holes 75*b* offset from each other so that one end of one alignment hole is overlapped with the other end of the corresponding alignment hole. Only several ones of the alignment holes 75*b* are shown in the figures for the purpose of simplification of the drawing while the remaining ones being indicated by imaginary lines. Each of the pin contacts 10 is adjacent to one end of the alignment hole 75*b* of the inner insulation film 75*a* and the other end of the alignment hole 75*b* of the outer insulation film 75*a*. A combination of the corresponding alignment holes will be referred to as the positioning hole that is inclined in the manner similar to the connector illustrated in FIGS. 19 and 20.

In the connector, the guide pin 75*d* is inserted into the guide hole 102*a* of the insulation socket 101 as illustrated in FIG. 22 in the manner similar to the connector illustrated in FIGS. 19 and 20. The stepped portions 75*e* and 102*b* are engaged with each other in the first direction Y. Each of the pin contacts 10 is positioned at the center of each positioning hole 75*b* of the insulation housing 75. Generally, the integral assembly of the insulation socket 101 and the housing member 70 is dealt with separately from the insulation plug 102.

For obtaining the predetermined connection, the insulation plug 101 is inserted into the integral assembly.

Then, the drive cam is driven to cause relative movement of the upper and the lower insulation housings 71 and 72 in the second direction X. Thus, the contact force is produced between the pin contacts 10 and the socket contacts 2.

Ninth Embodiment

Figure 23:
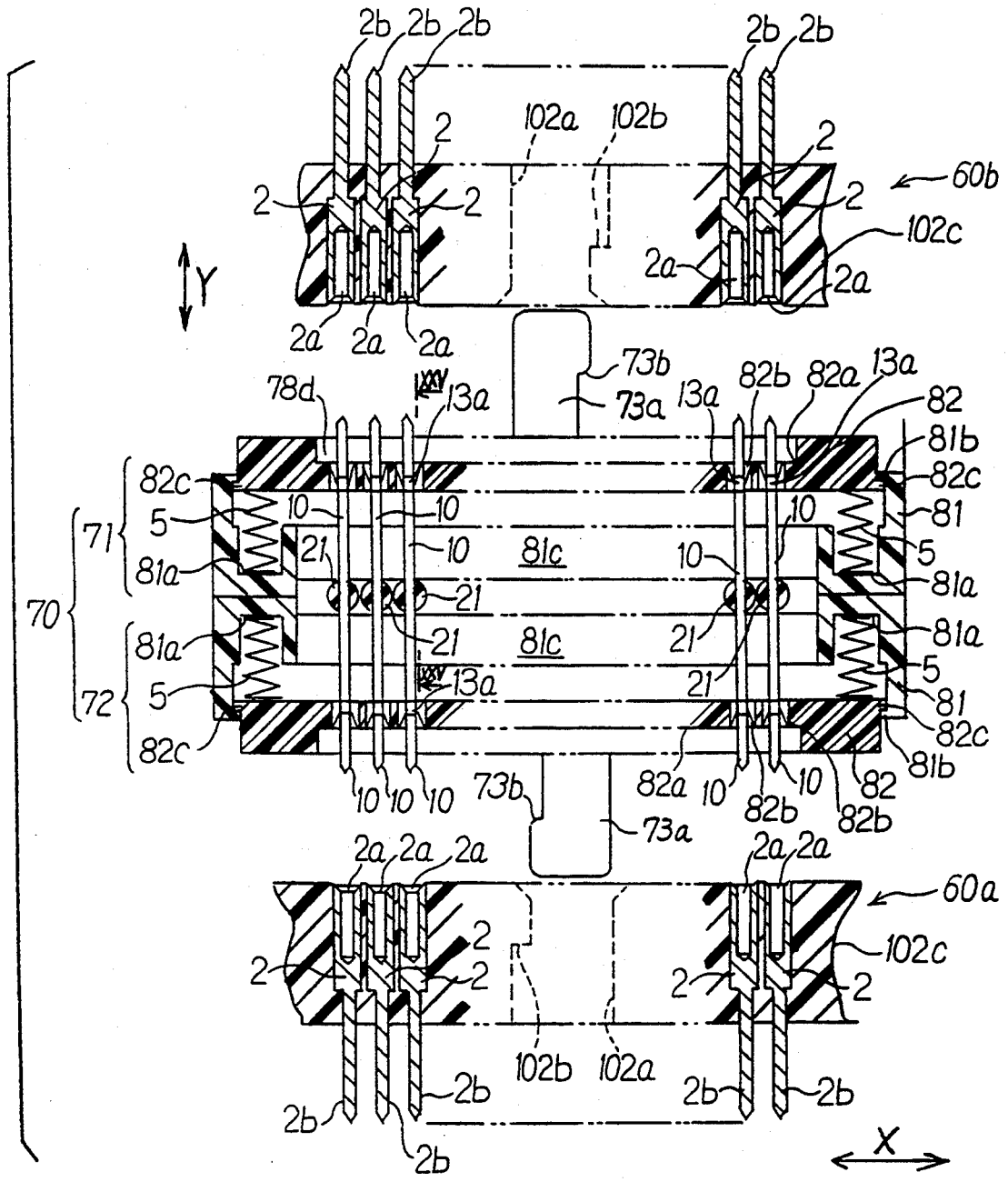
FIG. 23 is a sectional view of a part of a connector according to a ninth embodiment of this invention, in which the connector is on the disconnection state.
Figure 24:
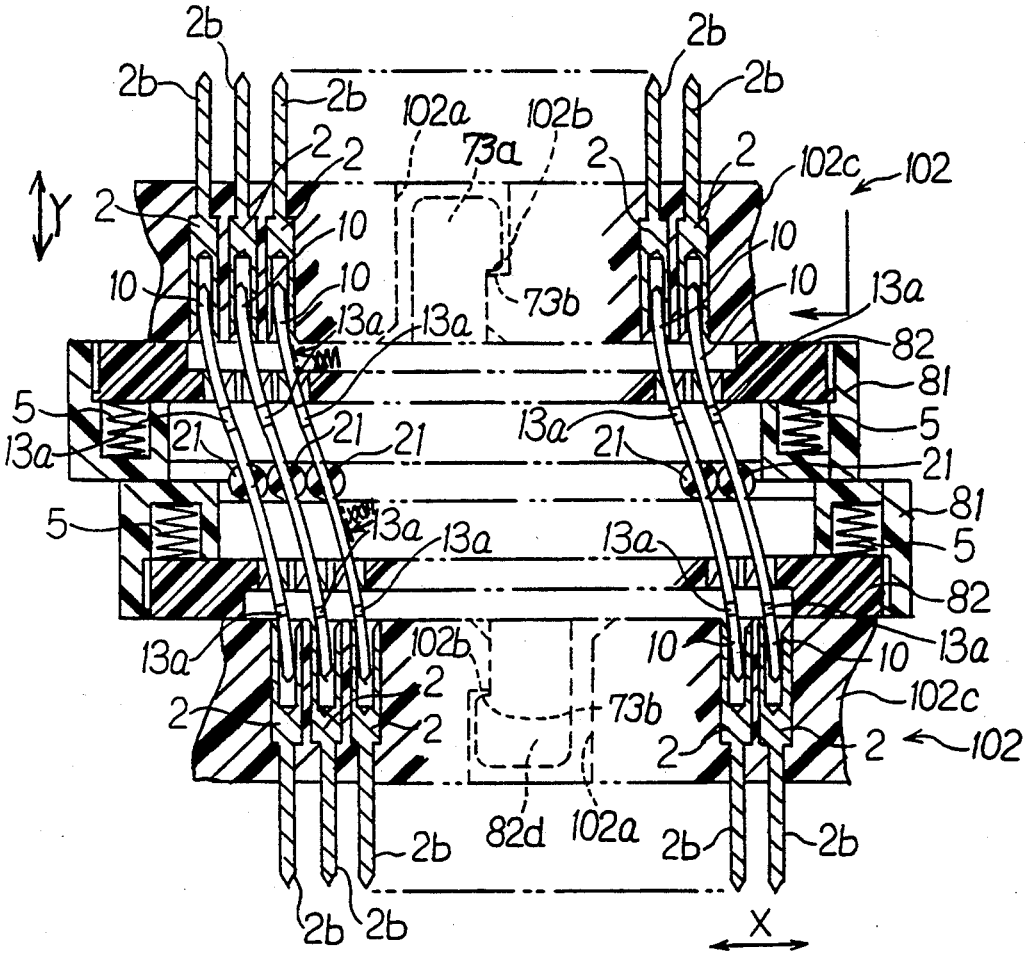
FIG. 24 sectional view similar to FIG. 23, in which the connector is on the connection state.

FIGS. 23 and 24 shows a connector according to a ninth embodiment of this invention. The connector comprises similar parts designated by like reference numerals. Although not shown in the figure for brevity of description, the connector comprises a housing member, a return spring, and a drive cam, like the connector that is illustrated in FIGS. 17 and 18.

Each of the insulation housings 71 and 72 includes a pin holding member 81 and a pin alignment member 82. Each pin holding member 81 holds the pin contacts 10. Each pin alignment member 82 is provided at its upper surface with a recessed portion 82*a* in which a plurality of cross-shaped alignment holes 82*b* are formed as the positioning holes. Each alignment hole 82*b* corresponds to each positioning hole 71*b* illustrated in FIGS. 17 through 20. Only several ones of the alignment holes 82*b* are shown in the figures for the purpose of simplification of the drawing while the remaining ones being indicated by imaginary lines. The alignment holes 82*b* have upper portions outwardly enlarged. Each of the pin contacts 10 has a flange 13*a* in correspondence to the alignment hole 82*b*. When the pin alignment member 82 is located at an uppermost or a lowermost position, the flange 13*a* is located within the alignment hole 82*b*.

Each pin alignment member 82 is provided with projecting pieces 82*c* formed at both sides thereof. The positioning pin 73*a* is integrally fixed to the pin holding member 81. Each pin holding member 81 is provided with spring insertion holes 81*a*. In the insertion holes 81*a*, springs 5 are inserted to urge the internal surface of the pin alignment member 82 in an outward direction.

The pin holding members 81 are provided with projecting pieces 81*b* formed at the interior of the upper and the lower ends thereof. The projecting pieces 81*b* of the pin holding members 81 engage the projecting pieces 82*c* of the pin alignment members 82 so as to inhibit release of the pin alignment members 82.

Figure 25:
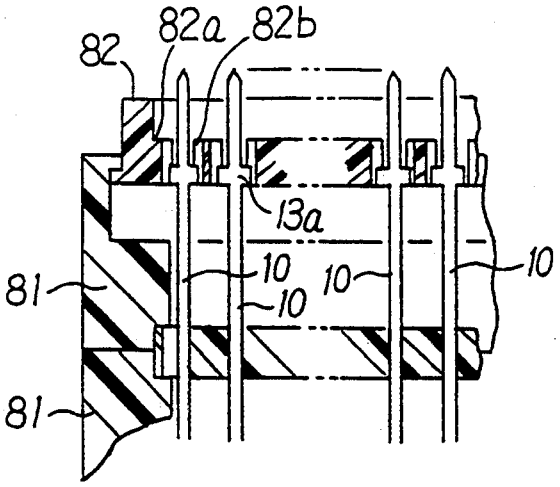
FIG. 25 is a sectional view taken along a line XXV—XXV of FIG. 23.
Figure 26:
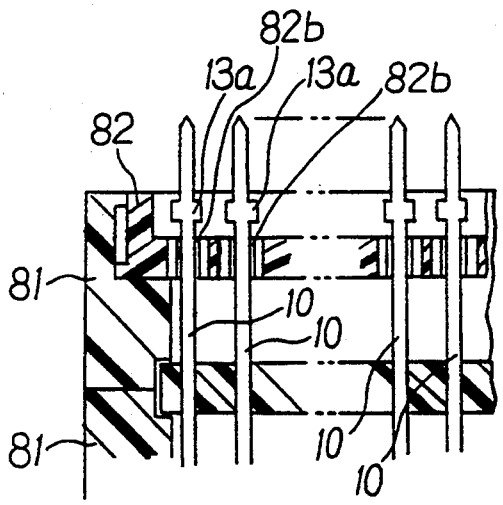
FIG. 26 is a sectional view taken along a line XXVI—XXVI of FIG. 24.

Before connection with the mating connector 60*b* is obtained, the flanges 13*a* are located within the alignment holes 82*b* as illustrated in FIG. 25. In this event, no swinging is allowed in a direction intersecting the longitudinal direction. When connection with the mating connector 60*b* is obtained, the pin alignment member 82 is moved down with energy storage of the spring 5 while the flanges 13*a* are outwardly exposed from the alignment holes 82*b* to project into the recessed portion 82*a*, as illustrated in FIG. 26.

In order to take the predetermined connection, the positioning pin 82*d* is inserted at first into the guide hole 102*d*. The pin contacts 10 are inserted into the lower socket contacts 2. Furthermore, the upper insulation housing 71 is pushed down while contracting the spring 5 until the stepped portion 73*b* is engaged with the stepped portion 102*b* in the first direction Y. Thus, an integral assembly is obtained which comprises the lower mating connector 60*a* and the housing member 70.

Next, to assemble the integral assembly and the upper socket contacts 2, the other ends of the pin contacts 10 are similarly inserted into the upper socket contacts 2. When the pin holding member 81 is slightly relatively moved in the lateral direction together with the pin alignment member 82, the stepped portions 73*b* and 102*b* of the positioning pin 73*a* and the guide hole 102*a* are engaged with each other to inhibit release of the upper mating connector 60*b* and the housing member 70.

In the above-mentioned state, the pin alignment member 82 is moved in the second direction X. In this event, the state illustrated in FIG. 24 is obtained without releasing the engagement between the stepped portions 73*b* and 102*b*. Thus, reliable connection is obtained between the pin contacts 10 and the socket contacts 2.

Tenth Embodiment

Figure 27:
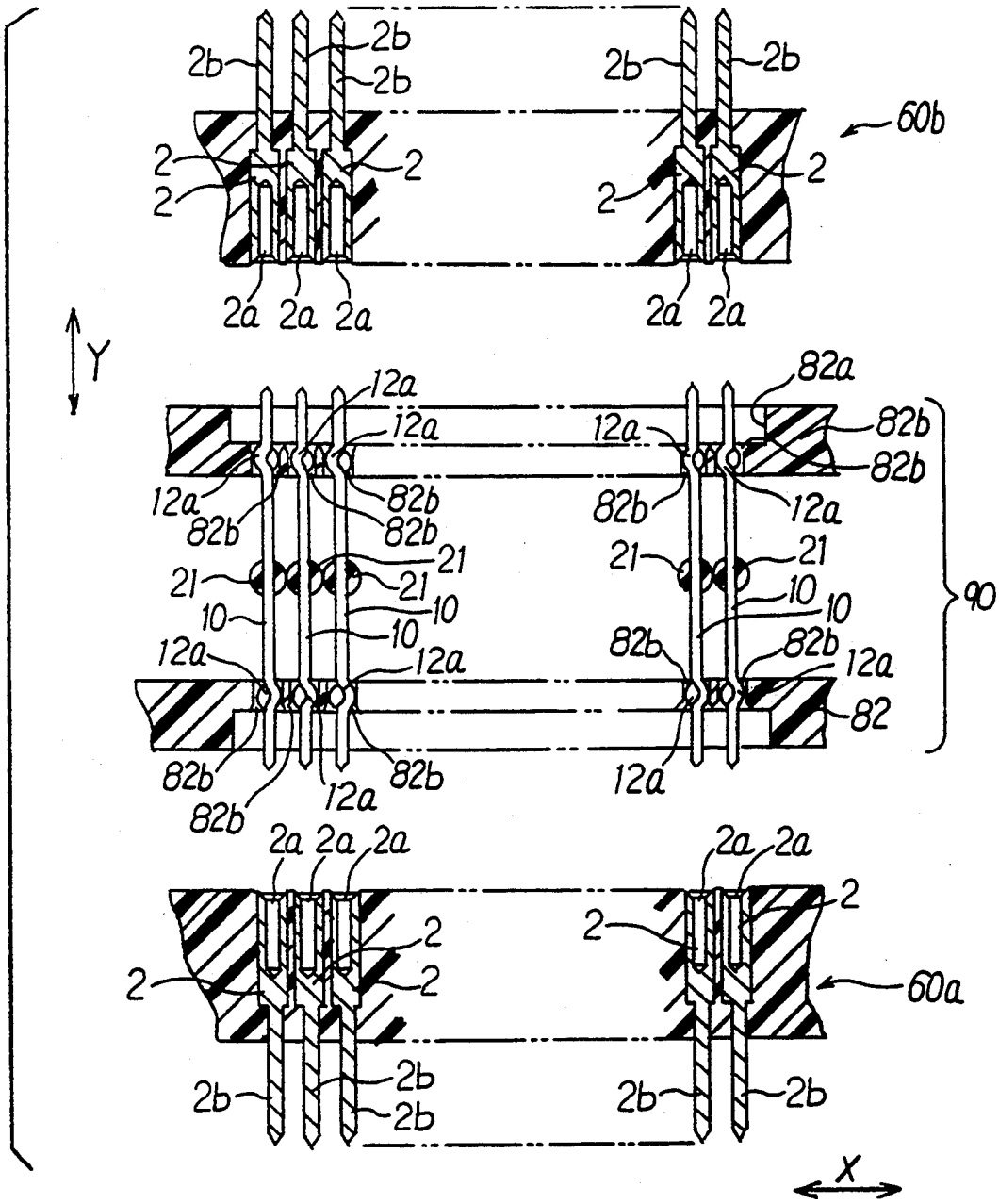
FIG. 27 is a sectional view of a connector according to a tenth embodiment of this invention, in which the connector is on the disconnection state.
Figure 28:
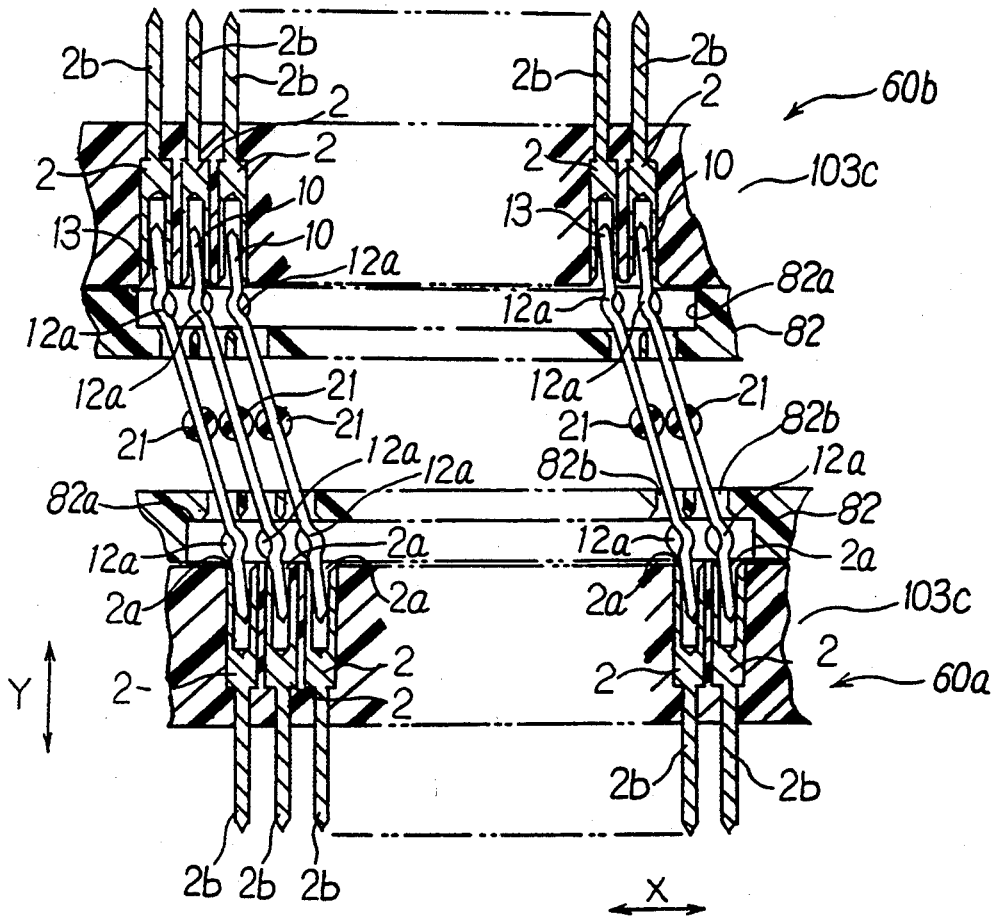
FIG. 28 is a sectional view similar to FIG. 27, in which the connector is on the connection state.

FIGS. 27 and 28 show a connector according to a tenth embodiment of this invention. Similar parts are designated by like reference numerals. Although not shown in the figure for brevity of description, the connector comprises a housing member, a return spring, and a drive cam, like the connector that is illustrated in FIGS. 17 and 18.

Referring to FIG. 27, each of the pin contacts 10 has projecting portions 12*a* which are formed at positions corresponding to the alignment holes 82*b* of the pin alignment members 82 and which roundly project in reverse directions to each other. In order to connect with the mating connector 60*a*, the pin contacts 10 are at first inserted into the socket contacts 2 in the manner similar to the connector illustrated in FIGS. 23 and 24. The lower pin alignment member 82 is gradually moved upwards. At this time, the projecting portions 12*a* of the pin contacts 10 are moved into the recessed portion 82*a*. Accordingly, each of the pin contacts 10 has an inner part which is nearer to the center of each pin contact than the projecting portions 12*a* and are located within the alignment holes 82*b*. As a result, the pin contacts 10 are given a degree of freedom about bending thereof.

Thus, an integral assembly of the lower mating connector 60*a* and the connector illustrated in FIGS. 27 and 28 is obtained. The integral assembly and the upper mating connector 60*b* are dealt with as separate unit components to each other. To assemble the integral assembly and the upper mating connector 60*a*, the one end of each of the pin contacts is inserted into each of the socket contacts 2. At this time, the upper pin alignment member 82 is pushed downwards to be moved down.

As illustrated in FIG. 28, after a socket housing 103*c* of the upper mating connector 60*b* is mounted on the upper surface of the pin alignment member 82, the mating connectors 60*a* are relatively moved in reverse to each other in the second direction X. As a result, the depth direction (namely, the first direction Y) of the socket contacts 2 and the orientation of the end portions of the pin contacts 10 are inclined with respect to each other to thereby provide connection between the contacts.

Eleventh Embodiment

Figure 29:
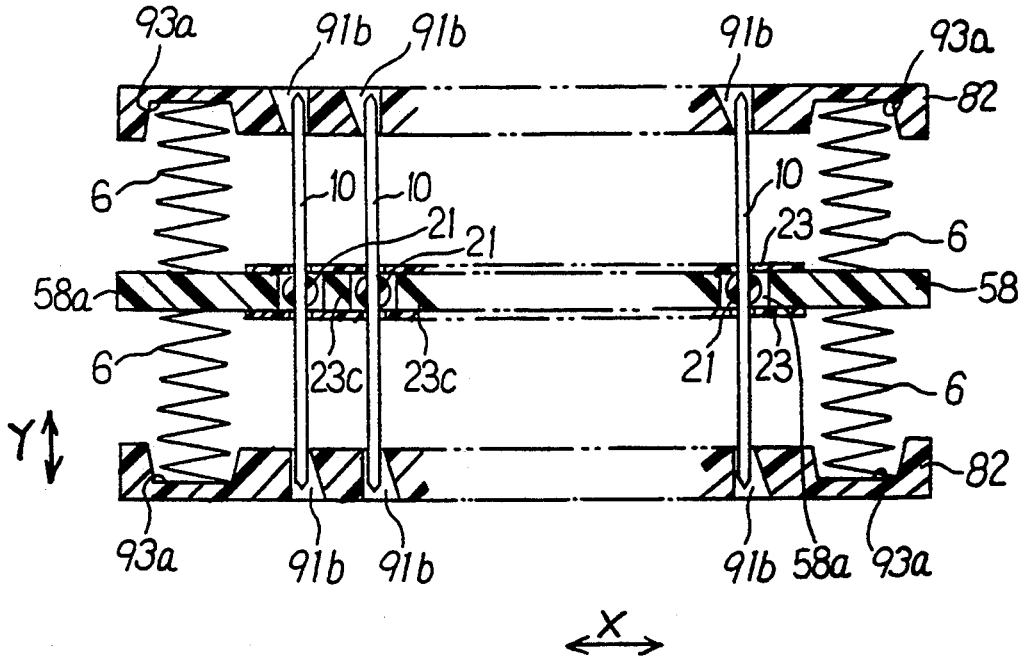
FIG. 29 is a sectional view of a connector according to an eleventh embodiment of this invention, in which the connector is on the disconnection state.
Figure 30:
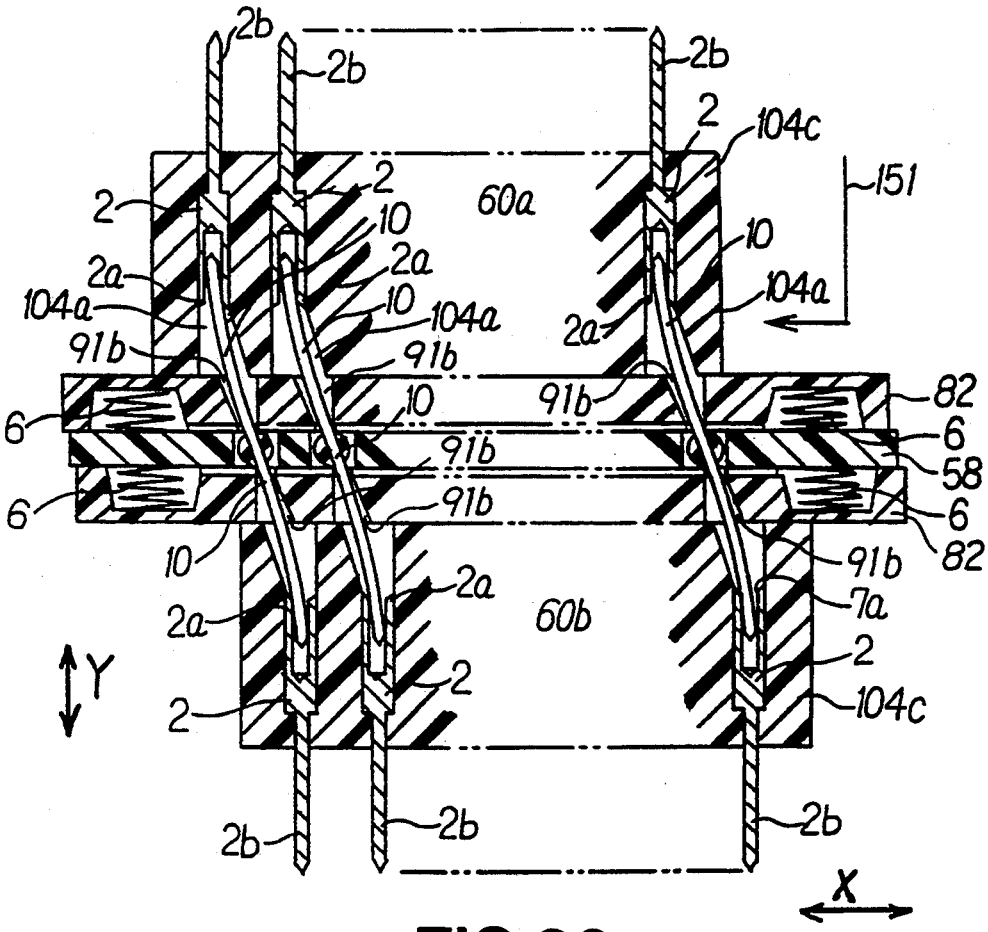
FIG. 30 is a sectional view similar to FIG. 29, in which the connector is on the connection state.

FIGS. 29 and 30 show a connector according to an eleventh embodiment of this invention. Similar parts are designated by like reference numerals.

Referring to FIG. 29, the pin alignment members 82 are provided with spring insertion holes 93*a* and a large number of pin alignment holes 91*b*. Only several ones of the pin alignment holes 91*b* are shown in the figures for the purpose of simplification of the drawing while the remaining ones being indicated by imaginary lines. Each pin alignment hole 91*b* corresponds to each alignment hole 82*b* in FIGS. 27 and 28 and has a bell shape with one side gradually outwardly widened in the first direction Y. The alignment hole 91*b* of the upper pin alignment member 82 has an inclined left side in the figure. The alignment hole 91*b* of the lower pin alignment member 82 has an inclined right side in the figure.

A holding portion 58 is interposed between the plate insulators 23. The holding portion 58 has through holes 58*a* for receiving the bridge members 21. The holding portion 58 extends further outwardly of the ends of the plate insulators 23. Compression springs 6 are placed between the holding portion 58 and the spring insertion holes 93*a*. In this state, the end portion of each of the pin contacts 10 are not exposed outwardly from the alignment holes 91*b*.

As illustrated in FIG. 30, the connector of FIG. 29 is interposed between the mating connectors 60*a* and 60*b*. The upper mating connector 60*b* is moved in a direction depicted by an arrow 151. As a result, the both top ends of the pin contacts 10 are outwardly projected from the pin alignment members 82 to be coupled with the socket contacts 2.

Twelfth Embodiment

Figure 31A:
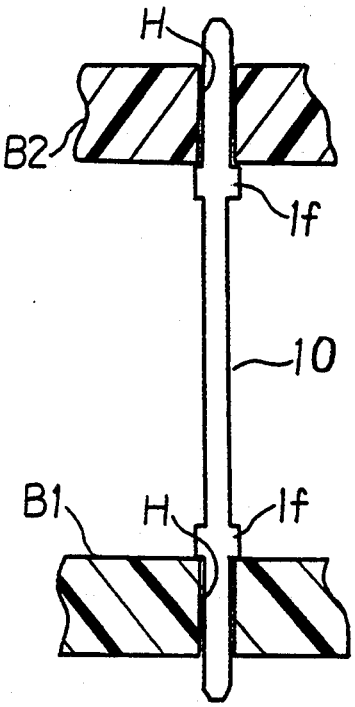
FIG. 31 shows, together with two circuit boards, a connector according to a twelfth embodiment of this invention, wherein (a) is a sectional view of a state in which a pin contact is inserted in a through hole, (b) being a sectional view of another state in which the pin contact is in press contact with an inner surface of the through hole, (c) being a side view of a state in which the connector connects the circuit boards to each other.
Figure 31B:
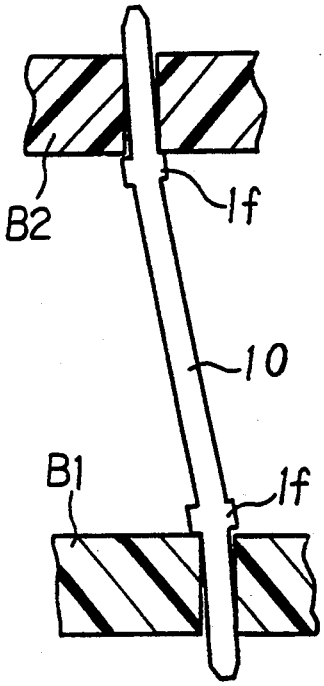
Figure 31C:
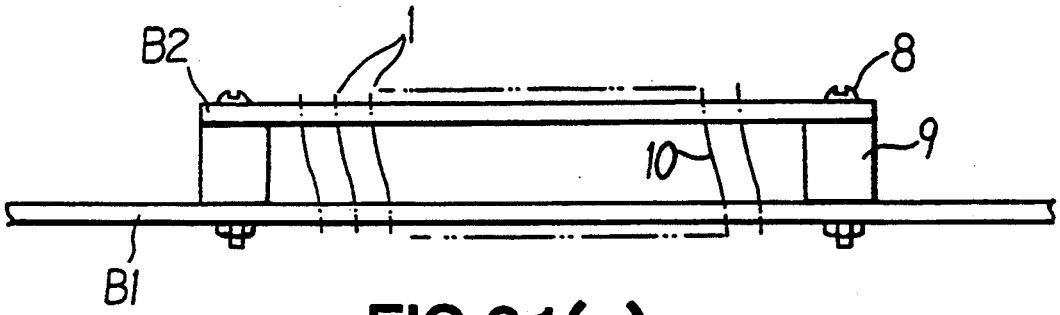

FIGS. 31(*a*), (*b*), and (*c*) show, together with first and second circuit boards B1 and B2 as the connection objects, a connector according to a twelfth embodiment of this invention. In the connector, each of the pin contacts 10 has a lower and an upper end. The lower end of each pin contact 10 is at first inserted into a through hole H on the first circuit board B1, as illustrated in FIG. 31(*a*). Next, the upper end of each pin contact 10 is inserted into another through hole H on the second circuit board B2. In the manner known in the art, each of the through holes H has an inner surface covered with a conductive layer.

The first and the second circuit boards B1 and B2 are relatively moved in parallel and in reverse to each other, as illustrated in FIG. 31(*b*). In this event, the lower and the upper ends of each pin contact 10 are pressed against both edge areas of internal walls within the through holes H in reverse directions. Bonding forces P and F are caused between each pin contact 10 and the both edge areas of the internal walls of the through holes H on the first and the second circuit boards B1 and B2, respectively. Thus, the both ends of each pin contact 10 are kept in press contact within the through holes H. Subsequently, the first and the second circuit boards B1 and B2 are fastened to each other at predetermined positions by fastening members such as screws 8 and spacers 9, as illustrated in FIG. 31(*c*).

With this structure, the first and the second circuit boards B1 and B2 are inhibited from being restored to initial positions due to elastic restoring force of the pin contacts 10. Thus, it is possible to maintain the connection between the first and the second circuit boards and the pin contacts.

In the figure, a reference numeral 1*f* represents flange portions formed on each of the pin contacts 10 and brought into contact with the opposite surfaces of the first and the second circuit boards B1 and B2. The flange portions 1*f* serve to determine the distance between the opposite surfaces of the first and the second circuit boards B1 and B2 so as to facilitate the assembling.

In addition, the lower end of each of the pin contacts 10 has an outer diameter which is selected to be such a size that allows light press-fit into the through hole H, namely, to be slightly greater than the inner diameter of the through hole H.

With this structure, when the lower end of each pin contact 10 is inserted into the through hole H on the first circuit board B1, each pin contact 10 stands perpendicularly to the first circuit board B1 with the upper end in accurate alignment with the through hole H on the second circuit board B2. As a result, assembling is readily made.

Figure 32:
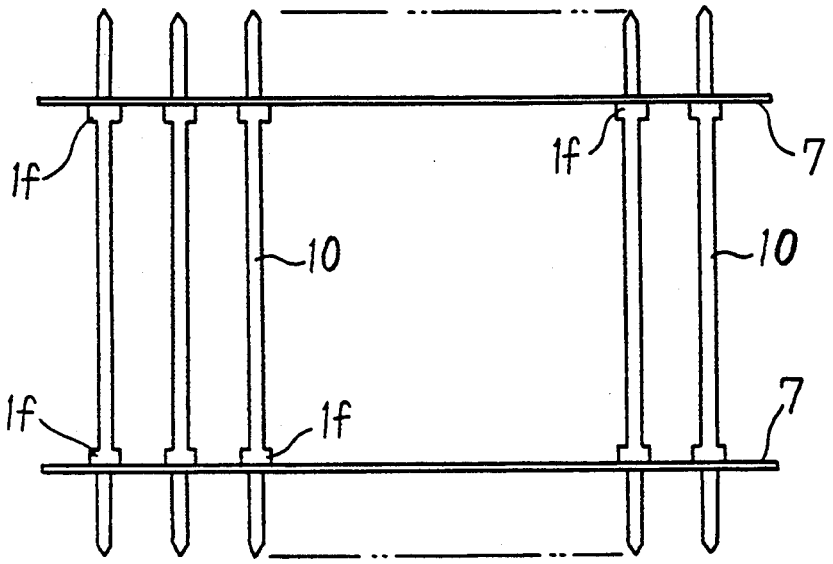
FIG. 32 is a front view of an example of structure for arranging a plurality of pin contacts.

As illustrated in FIG. 32, the pin contacts 10 may be arranged at a mutual distance equal to that of the through holes formed on the first and the second circuit boards B1 and B2. In this event, they are held together in alignment by first and second insulation films 7. To this end, each of the first and the second insulation films 7 is provided with a plurality of small holes for insertion of the pin contacts 10.

With this structure, the pin contacts 10 are held in alignment in correspondence to the mutual distance between the through holes. Thus, it is possible to simultaneously insert the pin contacts 10 into the through holes on the first and the second circuit boards B1 and B2 illustrated in FIGS. 31(*a*), (*b*), and (*c*).

In addition, the pin contacts 10 are kept in alignment. Accordingly, it is not essential to insert the pin contacts 10 into the through holes in a light press-fit manner. Insertion may be made in a loose-fit manner with a gap left between the pin contact and the through hole.

Figure 33:
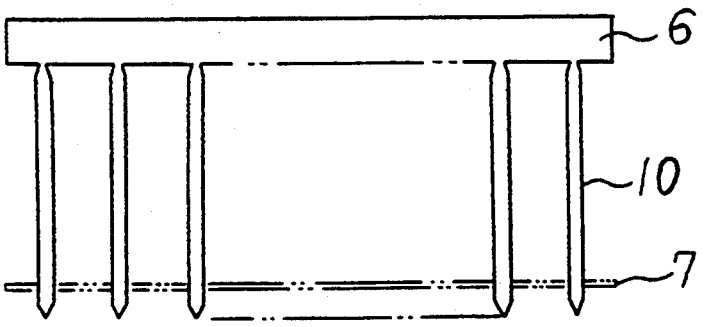
FIG. 33 is a front view of another example of structure for arranging the pin contacts.

As illustrated in FIG. 33, the pin contacts 10 may be integrally molded so that the upper ends thereof are coupled by a bridge portion 6. After the pin contacts are inserted into the through holes on the first and the second circuit boards from one to another, the first and the second circuit boards are relatively moved in parallel and in reverse to each other in the manner described with reference to FIGS. 30(*a*), (*b*), and (*c*). Then, the first and the second circuit boards are fastened to each other at predetermined positions by fastening members. Subsequently, the bridge portion 6 is removed from the pin contacts 10. Removal of the bridge portion 6 may be carried out following insertion of the pin contacts 1 into the both through holes. If a notch is formed between the bridge portion 6 and the pin contacts 10, the bridge portion 6 can be readily snapped off. With this structure, removal of the bridge portion 6 is easily made. It will be assumed that the pin contacts 1 are unstable. In this event, only the first insulation film 7 may be attached to the lower ends of the pin contacts 10 for alignment.

Figure 34A:
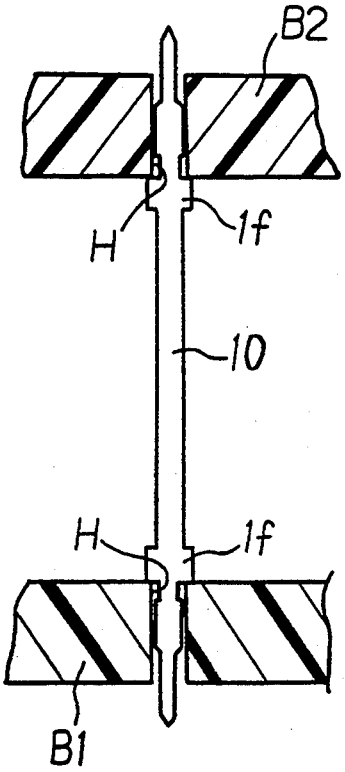
FIG. 34 shows, together with two circuit boards, a connector according to a thirteenth embodiment of this invention, wherein (a) is a sectional view of a disconnection state of the connector, (b) being a sectional view of a connection state of the connector.
Figure 34B:
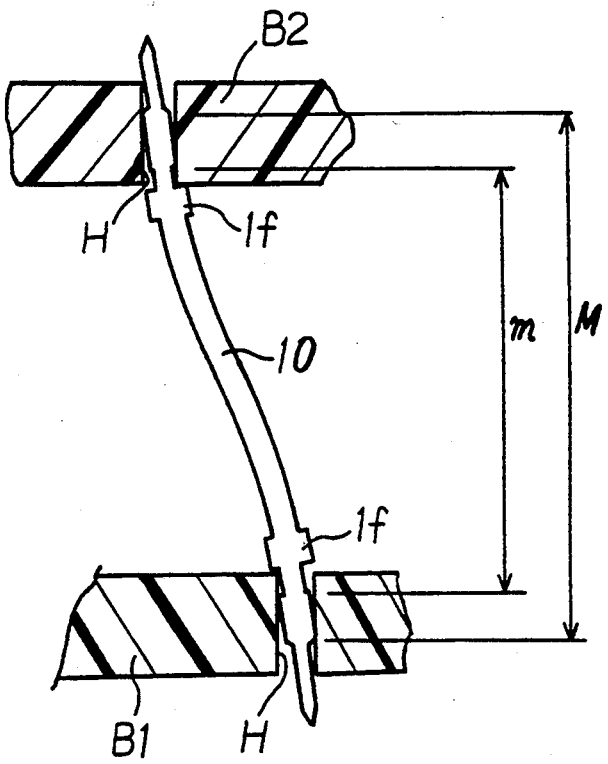

FIG. 34 shows, together with the first and the second circuit boards B1 and B2, a connector according to a thirteenth embodiment of this invention. In the connector, each pin contact 10 has a reduced diameter at their parts inserted into the through holes H and adjacent to the edge areas of the through holes H. With this structure, each pin contact 10 has particular portions which are brought into press contact with the internal wall surfaces of the through holes H and are located inside of the edge areas. In this event, $(M-(m/M))$ has a small value. Thus, it is possible to reduce the operation force W for moving the first and the second circuit boards B1 and B2.

What is claimed is:

1. A connector for use in electrically connecting a pair of connection objects to each other, said connection objects being opposite to each other in a first direction and having a relative position which is changeable between a first and a second position with said change being in a second direction perpendicular to said first direction, said connection objects having inner surfaces which are electroconductive and which extend in said first direction to respectively define spaces, said connector comprising a pin contact of an electroconductive elastic material, said pin contact extending substantially in said first direction and having longitudinal opposite ends adapted to be respectively inserted into said spaces, said opposite ends being loosely fitted in said spaces when said relative position is said first position, each of said opposite ends being brought into a pressed contact with each of said inner surfaces at a plurality of points which are different in said first and said second directions with said pin contact having a longitudinal intermediate portion which is between said opposite ends and which is elastically deformed when said relative position is changed from said first position to said second position, said connector further comprising a pair of insulation housings between said connection objects, said insulation housings being opposite to each other in said first direction and relatively movable together with said connection objects in said second direction, each of said insulation housings having a positioning hole for receiving said pin contact in proximity to each of said opposite ends of the pin contact.

2. A connector as claimed in claim 1, further comprising an insulation bridge member extending in a third direction perpendicular to said first and said second directions and holding said longitudinal intermediate portion of the pin contact, said bridge member being movably arranged between said insulation housings.

3. A connector as claimed in claim 1, further comprising:

an insulation bridge member having an axis extending in a third direction perpendicular to said first and said second directions and holding said intermediate portion of the pin contact; and a holding member held between said insulation housings and movable in said second direction, said holding member holding said bridge member so that said bridge member is rotatable around said axis.

4. A connector as claimed in claim 3, said longitudinal intermediate portion having a longitudinal center portion, wherein said connector further comprises a link mechanism coupling said holding member to said insulation housings so that said holding member is substantially kept in a stationary state irrespective of relative movement between said insulation housings, said bridge member holding said longitudinal center portion, whereby elastic deformation of said intermediate portion is symmetrical with respect to said center portion.

5. A connector as claimed in claim 1, further comprising:

a plate insulator receiving said intermediate portion of the pin contact so as to allow inclination of said pin contact; and preventing means for preventing said pin contact from being released from said plate insulator, said plate insulator being arranged between said insulation housings.

6. A connector as claimed in claim 5, wherein said plate insulator has two insulation plates opposite to each other with a space left therebetween in said first direction, each of said insulation plates having a hole for receiving said intermediate portion of the pin contact, said preventing means including a flange portion formed integral with said pin contact and interposed between said insulation plates, said flange portion being engaged with each of said insulation plates.

7. A connector as claimed in claim 5, wherein said pin contact includes two stepped portions at two parts spaced in a longitudinal direction of said pin contact, said stepped portions projecting in reverse to each other, said plate insulator having two insulation plates opposite to each other in said first direction, each of said two insulation plates being provided with a hole which has a size that allows passage of said stepped portions, said pin contact having parts which extend between said stepped portions and which are inserted into said holes in said insulation plates, said insulation plates being moved in reverse to each other in said second direction and in reverse to each of said stepped portions to make said stepped portions be faced against said insulation plates in said longitudinal direction.

8. A connector as claimed in claim 5, further comprising an insulation bridge member holding said intermediate portion of the pin contact, said plate insulator having two insulation plates opposite to each other with a space left therebetween in said first direction, each of said insulation plates being provided with a hole for receiving said intermediate portion, said bridge member being arranged between said insulation plates.

9. A connector as claimed in claim 1, said pin contact having a pin diameter, wherein said positioning hole has a hole diameter substantially greater than said pin diameter, said connector further comprising an offset spring for bring said pin contact into press contact with a part of the inner surface of said positioning hole.

10. A connector as claimed in claim 1, said pin contact having a pin diameter, wherein said positioning hole extends in a fourth direction inclined with respect to said first and said second directions, said positioning hole having a hole diameter enough greater than said pin diameter, said positioning hole having an inclination direction extending along said pin contact that is deformed when said relative position is said second position, swinging of said pin contact being inhibited by opposite edges at both ends of said positioning hole when said relative position is said first position.

11. A connector as claimed in claim 1, wherein each of said insulation housings includes two thin films opposite to each other with a space left therebetween in said first direction, said films being provided at corresponding positions with hole elements, respectively, said hole elements having equal diameters to each other and forming said positioning hole in combination, said hole elements being offset from each other in a direction extending along said pin contact that is deformed when said relative position is said second position.

12. A connector as claimed in claim 1, said positioning hole having a hole axis, wherein said positioning hole has a plurality of grooved formed in its internal surface and extending in parallel to said hole axis, said pin contact having in proximity of said opposite ends a plurality of flanges corresponding to said grooves, said insulation housings being movable in said first direction between a specific position where said flanges are inserted into said grooves and another position where said insulation housings approach each other nearer than at said specific position.

13. A connector as claimed in claim 1, wherein said pin contact has an expanding portion at said intermediate portion, said positioning hole having a size that allows insertion of said expanding portion, said insulation housings being movable in said first direction between a specific position where said expanding portion is inserted into said positioning hole and another position where said insulation housings approach each other nearer than at said specific position.

14. A connector as claimed in claim 12 or 13, further comprising urging means for urging said insulation housings towards said specific position.

15. A connector as claimed in claim 1, said pin contact having a pin diameter, wherein said positioning hole formed on one of said insulation housings has a hole diameter which is slightly greater than said pin diameter at a first end facing another of said insulation housings and which is enlarged in said second direction towards a second end opposite to said first end.

16. A connector as claimed in claim 1, wherein said insulation housings are arranged between said connection objects, said connector further comprising a guide hole and a positioning pin which are adapted to fit to each other in said first direction so as to align a selected one of said insulation housings and said connection object faced to said selected one of the insulation housings, said guide hole and said positioning pin being provided at the intermediate portion in said first direction with stepped portions which allows relative movement of said selected one of the insulation housings and said connection object that faces said selected one in said second direction.

17. A connector as claimed in claim 1, wherein said connection objects comprise a first and a second circuit board each having two principal surfaces which are parallel to each other, said first and said second circuit boards having a first and a second through hole providing said spaces, respectively, each of said first and said second through holes extending between said principal surfaces, said opposite ends of the pin contact being inserted in said first and said second through holes, respectively.

18. A connector as claimed in claim 17, wherein a selected one of said opposite ends of the pin contact is inserted into said first through hole in a first condition, another one of said opposite ends being inserted into said second through hole with a fit which is loose when in a second condition as compared to a fit when in said first condition.

19. A connector as claimed in claim 17, wherein said pin contact has a first and a second flange portion which are located between said first and said second circuit boards to prevent said pin contact from a movement thereof in said first direction in cooperation with said first and said second circuit boards, respectively.

20. A connector as claimed in claim 19, wherein said first and said second flange portions are brought into engagement with said first and said second circuit boards, respectively.

21. A connector as claimed in claim 19, wherein said first flange portion has a first film member facing said first circuit board and, said second flange portion having a second film member facing said second circuit board, said first and said second film members being brought into engagement with said first and said second circuit board.

22. A connector as claimed in claim 17, each of said first and said second through holes having end portions and an intermediate portion between said end portions, said pin contact having a first radial size at each of positions corresponding to said end portions and a second radial size at a position corresponding to said intermediate portion, wherein said first radial size is smaller than said second radial size.

23. An electrical connector having at least two plastic parts each with a surface, said surfaces confronting each other when said at least two parts are assembled, a plurality of holes in each of at least two of said surfaces, said holes in said at least two surfaces being aligned with each other when said at least two surfaces are confronting each other, a plurality of elongated spring contact pins which fit into individually associated and corresponding ones of said aligned holes in each of said at least two surfaces, said spring contact pins bridging the at least two parts when fitted into said individually associated and corresponding holes, and means for sliding one of said parts relative to the other of said parts for deforming said pins in order to apply contact pressure between opposite ends of said pins and the holes in said at least two parts in which said pins are fitted.

24. The connector of claim 23 in which there are three of said parts, one of said parts being between the other two of said parts, said spring contact pins bridging said three of said parts when assembled in a face to face relationship, said means for sliding one of said parts being the one of said parts which is between the other two parts.

25. The connector of claim 23 wherein said at least two plastic parts confront but do not touch each other.

* * * * *